US006882809B2

(12) United States Patent
Hirose et al.

(10) Patent No.: US 6,882,809 B2
(45) Date of Patent: Apr. 19, 2005

(54) IMAGE FORMING DEVICE WITH DUCT FOR EXHAUSTING HEAT OUTSIDE MAIN BODY CASE

(75) Inventors: Atsuo Hirose, Nagoya (JP); Yasuo Tamaru, Nagoya (JP); Hidetoshi Yano, Toukai (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/397,338

(22) Filed: Mar. 27, 2003

(65) Prior Publication Data

US 2003/0185584 A1 Oct. 2, 2003

(30) Foreign Application Priority Data

Mar. 27, 2002 (JP) ..... 2002-089977
Mar. 27, 2002 (JP) ..... 2002-089982

(51) Int. Cl.[7] ..... G03G 15/00
(52) U.S. Cl. ..... 399/92
(58) Field of Search ..... 399/92, 93, 94

(56) References Cited

U.S. PATENT DOCUMENTS 6,205,302 B1 3/2001 Yokota
2002/0057920 A1 5/2002 Yano

FOREIGN PATENT DOCUMENTS

| | | |
|---|---|---|
| JP | (A) 5-127481 | 5/1993 |
| JP | (B2) 6-14201 | 2/1994 |
| JP | (A) 7-325539 | 12/1995 |
| JP | 10-133550 | * 5/1998 |
| JP | (A) 10-207307 | 8/1998 |
| JP | (A) 11-24352 | 1/1999 |
| JP | (A) 11-95644 | 4/1999 |
| JP | 2001-318576 | * 11/2001 |

* cited by examiner

*Primary Examiner*—Quana Grainger
(74) *Attorney, Agent, or Firm*—Oliff & Berridge, PLC

(57) ABSTRACT

A laser printer for forming toner images on sheets includes a duct wall and a shutter. The duct wall extends between a process cartridge, which is filled with toner, and a thermal fixing unit, which generates heat to fix toner images onto the sheets. The duct wall defines a duct and is formed with openings at its side that faces the thermal fixing unit. A fan is provided for drawing hot air from the thermal fixing unit, through the openings in the duct wall and the duct itself, and out from the laser printer. The shutter moves in and out of contact with the process cartridge in association with opening and closing movement of a cover of the laser printer. When the shutter is in contact with the process cartridge, an exhaust chamber is formed that connects an ozone exhaust hole of the process cartridge with the duct. Another fan is provided for drawing the ozone generated by a charge unit of the process cartridge through the ozone exhaust hole, the exhaust chamber, and the duct.

32 Claims, 18 Drawing Sheets

IMAGE FORMING DEVICE WITH DUCT FOR EXHAUSTING HEAT OUTSIDE MAIN BODY CASE

BACKGROUND OF THE INVENTION

1. Field of the Invention

The present invention relates to an image forming device such as a printer, a copying machine, a facsimile, or a multi-function device that includes several functions that require image formation, and more particularly to image forming device that includes a duct for discharging heat, ozone, and the like.

2. Related Art

Laser printers, copying machines, and other similar image forming devices include a photosensitive member. To form images, the surface of the photosensitive member is charged using a corona discharge. The charged surface is then exposed with light from a laser or a light emitting diode (LED). Exposed portions on the surface of the photosensitive member form an electrostatic latent image. The electrostatic latent image is developed by toner into a visual toner image. The toner image is transferred from the photosensitive member onto a recording medium such as paper. The toner image is thermally fixed onto the recording medium by a fixing device.

Various components used in the process generate heat. For example, a scanner motor is provided for rotating a polygon mirror to scan a laser beam across the surface of the photosensitive member. The scanner motor generates heat as it rotates the polygon mirror during image formation. Also the fixing device itself generates heat. A duct is provided in the image forming device to exhaust the heat to outside of the main body case 2.

In addition, ozone is generated from the corona discharge for charging the surface of the photosensitive member. Nitrogen oxide and silicon dioxide are also generated. Cation radicals are generated in the charge transfer layer of the photosensitive member when the charge transfer layer is exposed to a mixture of the ozone and nitrogen dioxide under a highly humid environment. The cation radicals deteriorate the charge transfer layer so that various electric characteristics of the charge transfer layer are reduced. For example, sensitivity and electric potential of the charge transfer layer are reduced and residual potential is increased. The poor electric characteristics adversely affect formation of the electrostatic latent image, so that image quality drops. A duct provided with a fan and an ozone filter is provided for removing ozone from the image forming device.

In order to make image forming devices more compact, the difference components are arranged in the main body case 2 within close proximity to each other. Also, high speed operation of image forming devices has increased the amount of heat generated by the components of the device. When the fixing device or other heat generating component is located close to a process cartridge, the heat from the fixing device can thermally affect the process cartridge. More specifically, the process cartridge holds toner that can deteriorate when heated. The deteriorated toner results in defective image formation.

An independent exhaust chamber is provided for discharging ozone. The exhaust chamber takes up space, so limits how compact the image forming device can be produced. The exhaust chamber needs to be opened and closed. Therefore, a movable member for opening and closing the exhaust chamber and also a drive source such as a solenoid must be provided. The image forming device becomes more complicated and expensive to produce.

SUMMARY OF THE INVENTION

It is an objective of the present invention to overcome the above-mentioned problems.

In order to achieve the above-described objective, an image forming device according to one aspect of the present invention is for forming developer images on a recording medium and includes a main body case, an image bearing member, an image forming unit, a process cartridge, a developing unit, a transfer unit, a fixing unit, a duct wall, and an exhaust unit.

The image bearing member is disposed within the main body case and has a surface.

The image forming unit is disposed within the main body. The image forming unit forms an electrostatic latent image on the surface of the image bearing member.

The process cartridge is removably disposed in the main body case.

The developing unit is disposed within the process cartridge. The developing unit holds developer and uses the developer to develop the electrostatic latent image on the image bearing member into a developer image.

The transfer unit is disposed within the main body case at a position in opposition with the process cartridge. The transfer unit transfers the developer image on the image bearing member onto the recording medium.

The fixing unit is disposed within the main body case. The fixing unit generates heat to thermally fix the developer image onto the recording medium.

The duct wall has a cartridge-side wall section opposed to the process cartridge, a fixing-unit-side wall section opposed to the fixing unit, and a connecting wall section that connects the cartridge-side wall section and the fixing-unit-side wall section together. The cartridge-side wall section, the fixing-unit-side wall section, and the connecting wall section define a duct that extends between the fixing unit and the process cartridge. The connecting wall section and the fixing-unit-side wall section are formed with a fixing-unit-side through hole that extends from a portion of the connecting wall section to a portion of the fixing-unit-side wall section.

The exhaust unit draws air in the vicinity of the fixing unit, through the through hole and the duct, to outside the main body case.

An image forming device according to another aspect of the present invention includes a detachable process cartridge, a main body case, a movable member, and an exhaust unit.

The detachable process cartridge forms images on recording medium and includes a housing, a photosensitive member, and a charger. The housing supports the photosensitive member and the charger in confrontation with each other. The housing is formed with a cartridge through hole near the charger. The charger charges the photosensitive member.

The main body case is formed with a receiving section and an exhaust hole. The receiving section receives the process cartridge. The exhaust hole brings the receiving section into fluid communication with outside the main body case.

The movable member moves between a contact position and a non-contact position. The movable member, when in the contact position, contacts the cartridge housing and defines an exhaust chamber that connects the exhaust hole of the receiving section to the cartridge through hole. The movable member, when in the non-contact position, is out of contact with the cartridge housing.

The exhaust unit draws air through the exhaust chamber and the exhaust hole together to outside of the main body case.

DETAILED DESCRIPTION OF THE PREFERRED EMBODIMENTS

Figure 1:
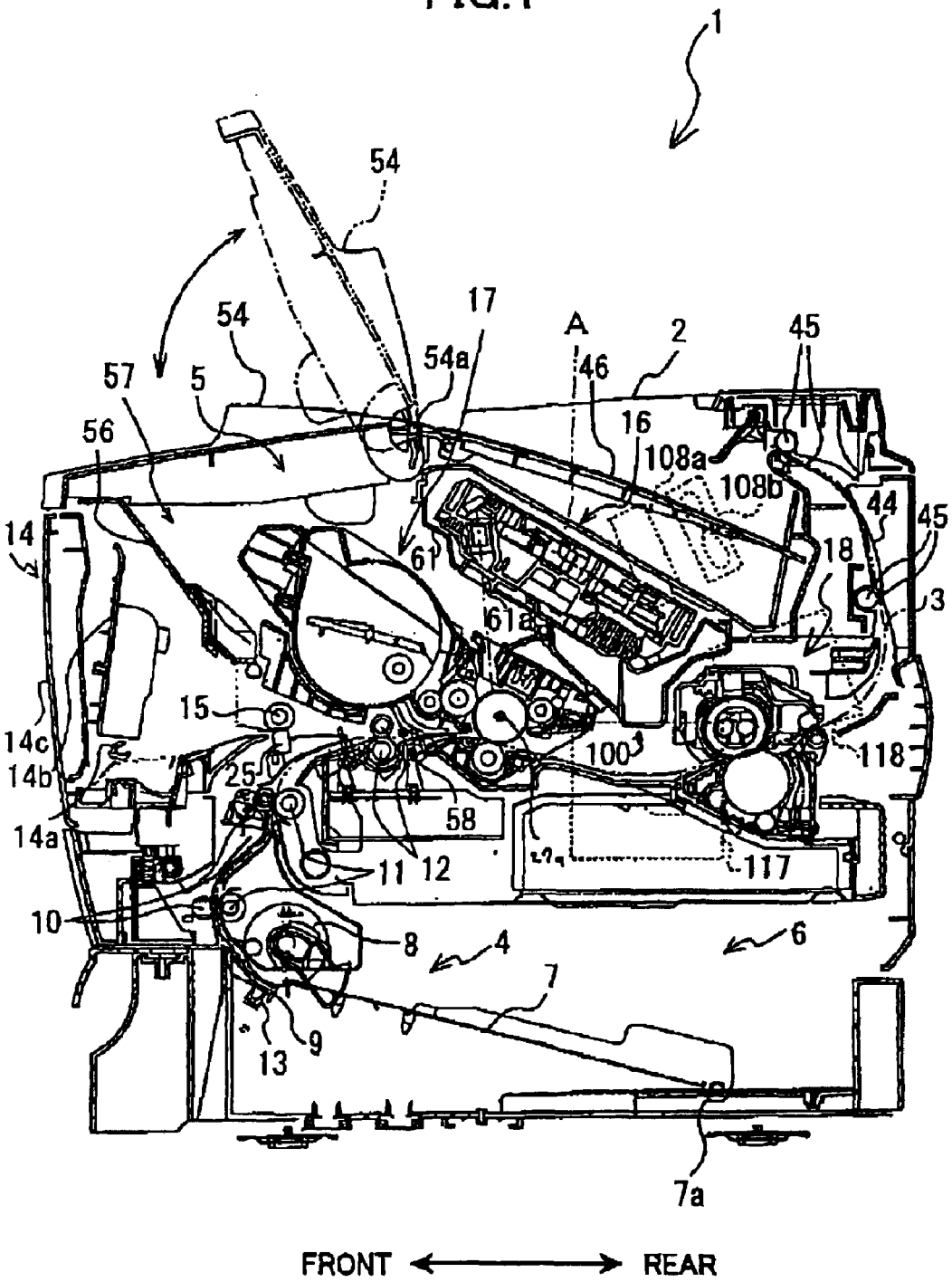
FIG. 1 is a sectional view showing a laser printer according to a first embodiment of the present invention.

A laser printer 1 according to a first embodiment of the present invention will be described with reference to the attached drawings. First, the overall structure of the laser printer 1 will be described with reference to FIG. 1. As shown in FIG. 1, in a sectional view, the laser printer 1 includes a main body case 2, a feeder section 4, and an image forming section 5. The feeder section 4 and the image forming section 5 are disposed within the main body case 2. The feeder section 4 is for feeding sheets 3 to the image forming section 5, which forms images on the fed sheets 3. Note that, in the laser printer 1, the left side in FIG. 1 is a front surface of the laser printer 1.

The main body case 2 includes a sheet discharge tray 46 at the rear half of its upper surface. The sheet discharge tray 46 is formed in a recessed shape such that printed sheets 3 can be stacked and held thereon. The main body case 2 is formed with an opening in front of the sheet discharge tray 46. The space is continuous with a cartridge receiving section 57 inside the main body case 2. A process cartridge 17 is detachably inserted into the cartridge receiving section 57. An upper surface cover 54 is pivotably disposed on a shaft 54*a* provided to the front of the sheet discharge tray 46, and can selectively open and close the cartridge receiving section 57. Note that a position when the upper surface cover 54 is opened is indicated by an two-dot chain line in FIG. 1.

In a rear part in the main body case 2 (right side in FIG. 1), a sheet delivery path 44 is provided following a vertically extending arc at the back of the main body case 2. Sheets 3 delivered from a fixing device 18 of the image forming section 5 provided on a rear end side in a lower part of the main body case 2 are guided to the sheet discharge tray 46. On the sheet delivery path 44, a sheet delivery roller 45 for conveying the sheet 3 is provided. Note that, in the laser printer 1, because the sheet delivery path 44 is thus formed in an arc, a so-called face down sheet delivery can be performed. In face down sheet delivery, the surface of the sheet 3 formed with an image is delivered onto the sheet discharge tray 46 facing downward. This is convenient when printing consecutive images on a plurality of sheets. Because the sheets 3 are stacked in order with their printed surface facing downward, the printed sheet 3 are arranged in the desired order of printing.

The feeder section 4 includes: a sheet feed roller 8 which is provided on a bottom part in the main body case 2 and above an end at one side of a sheet feed tray 6 and with which the sheets 3 are brought into contact by a sheet pressing plate 7; the sheet feed tray 6 in a detachably mounted condition; the sheet pressing plate 7 which is provided in the sheet feed tray 6 and supports the sheets 3 in a stack to bring the sheets 3 into pressed contact with the sheet feed roller 8; a separation pad 9 which is pressed toward the sheet feed roller 8, nips and conveys the sheets 3 in cooperation with the sheet feed roller 8 at the time of sheet feed, and prevents double feed of the sheets 3; conveying rollers 11 which are provided at two positions downstream from the sheet feed roller 8 in a conveying direction of the sheets 3 and which perform conveyance of the sheets 3; paper powder removing rollers 10 which come into contact with the respective conveying rollers 11 with the sheet 3 therebetween to remove paper powder and, at the same time, perform conveyance of the sheets 3 in cooperation with the conveying rollers 11; and registration rollers 12 which are provided on downstream from the conveying rollers 11 in the conveying direction of the sheets 3 and which adjust timing for delivering the sheets 3 at the time of printing.

The sheet pressing plate 7 supports the sheets 3 in stack. On end of the sheet pressing plate 7 is disposed adjacent to the sheet feed roller 8. The opposite end is pivotably supported on a shaft 7*a* provided on the bottom surface of the sheet feed tray 6. The end of the sheet pressing plate 7 adjacent to the sheet feed roller 8 is therefore movable in the vertical direction with the shaft 7*a* as a pivotal center. The sheet pressing plate 7 is biased toward the sheet feed roller 8 by a spring (not shown) disposed on the under surface of the sheet pressing plate 7. Thus, the sheet pressing plate 7 is swung downward against a biasing force of the spring with the shaft 7*a* as a fulcrum by an amount corresponding to a stacked quantity of the sheets 3. The sheet feed roller 8 and the separation pad 9 are disposed in confrontation with each other, and the separation pad 9 is pressed toward the sheet feed roller 8 by a spring 13 disposed on the back of the separation pad 9.

The feeder section 4 includes a hand supply tray 14, a hand supply roller 15, and a separation pad 25. The hand supply tray 14 is provided in a front part of the main body case 2 (left side in FIG. 1) and includes a tray portion 14*b* and a cover portion 14*c*. The tray portion 14*b* is opened and closed by being moved in front and back directions (left and right directions in FIG. 1) with a shaft 14*a* as a fulcrum. Sheets 3 can be stacked on the tray portion 14*b* when it is open. The cover portion 14*c* is slidable with respect to the tray section 14*b* and becomes a part of the main body case 2 when the tray section 14*b* is closed. The hand supply roller 15 is for feeding the sheets 3 stacked on the tray section 14*b* of the hand supply tray 14. The separation pad 25 is for preventing double feed of the sheets 3.

The hand supply roller 15 and the separation pad 25 are disposed in confrontation with each other, and the separation pad 25 is pressed toward the hand supply roller 15 by a spring (not shown) disposed on the back of the separation pad 25. When printing, the sheets 3 stacked on the hand supply tray 14 are delivered by a frictional force of the rotating hand supply roller 15 and prevented from being doubly fed by the separation pad 25, thereby being conveyed to the registration rollers 12 one by one.

As indicated in dotted line in FIG. 1, the laser printer 1 includes three exhaust fans 3, that is, fans 108*b*, 117, and 118, and an ozone filter 108*a* on the left side (not shown) of the main body frame 2. The positional relationship among these exhaust fans and the image forming section 5 is as shown in FIG. 1.

Figure 2:
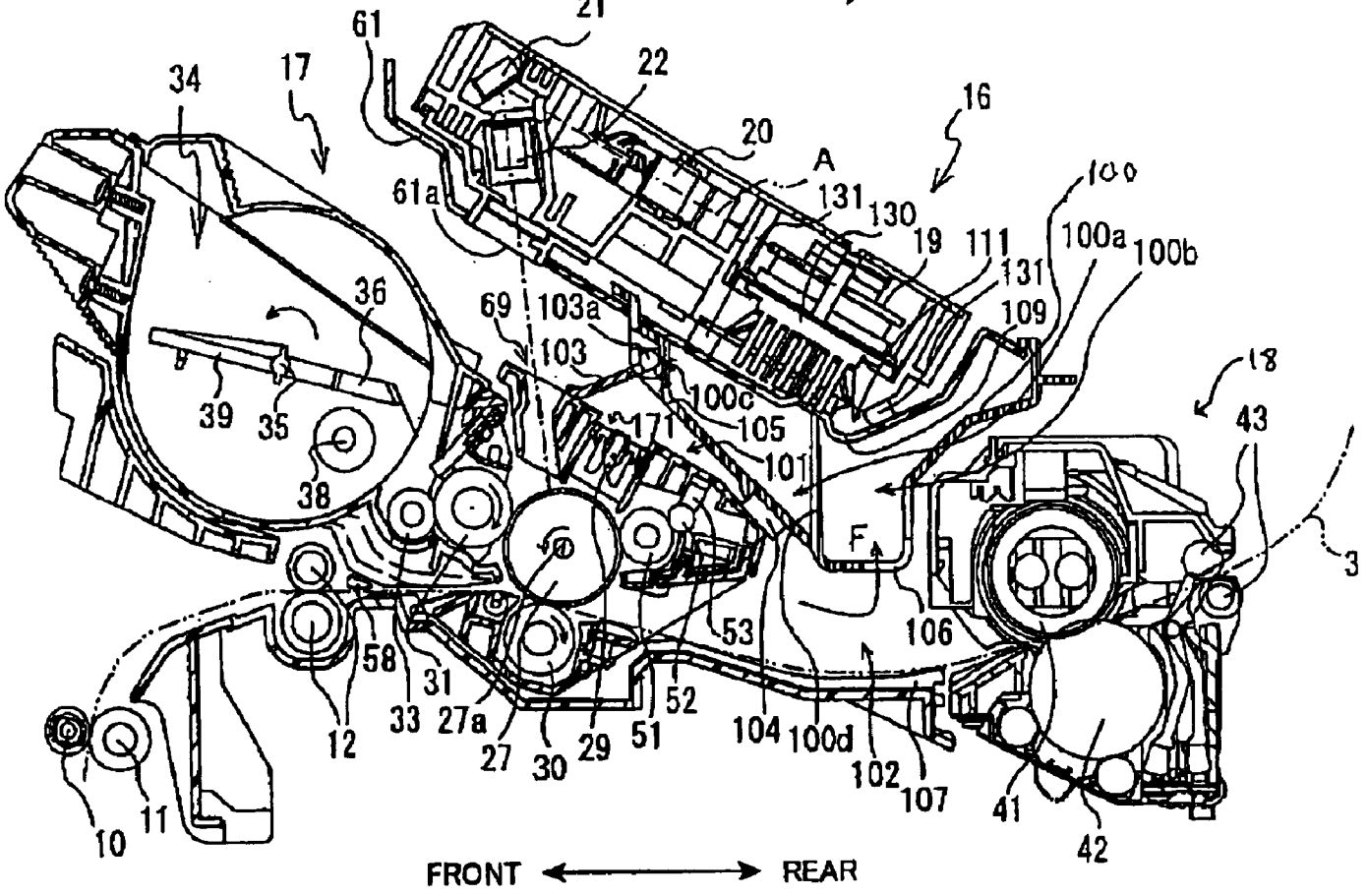
FIG. 2 is a sectional view showing an image forming section of the laser printer.
Figure 3:
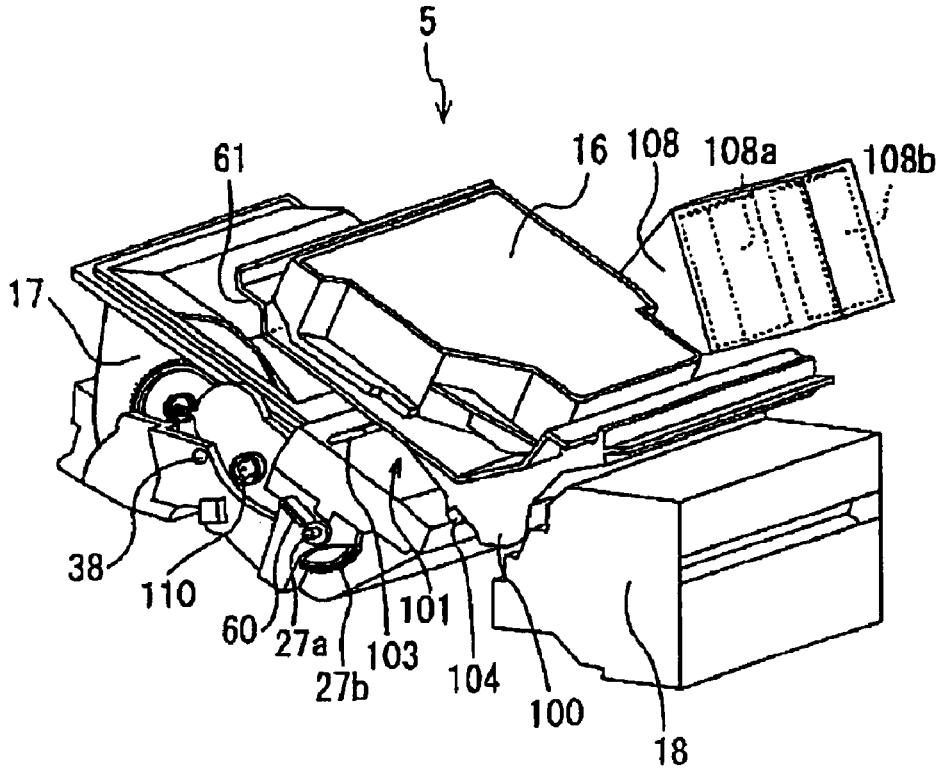
FIG. 3 is a perspective view showing the image forming section.

Next, a structure of the image forming section 5 will be described. The image forming section 5 is for forming an image on each sheet 3 conveyed by the feeder section 4. As shown in FIGS. 2 and 3, the image forming section 5 includes a scanner unit 16, the process cartridge 17, the fixing device 18, and a duct wall 100.

The scanner unit 16 includes: a laser beam emitting section (not shown) which is arranged below the sheet discharge tray 46 in the upper part of the main body case 2 and irradiates a laser beam; a polygon mirror 19 rotated by a motor (not shown) to scan the laser beam that was irradiated by the laser beam emitting section across a surface of a photosensitive drum 27 in a main scanning direction; a heat sink 130 for discharging heat generated by the motor that rotates the polygon mirror 19; an fθ lens 20 for regulating a scanning speed of the laser beam used for scanning by the polygon mirror 19 to a constant speed; a reflecting mirror 21 for reflecting the laser beam used for scanning; and a relay lens 22 for adjusting a focal position in order to focus the laser beam reflected by the reflecting mirror 21 on the photosensitive drum 27. The laser beam emitting section emits a laser beam based upon predetermined image data. The emitted laser beam passes through or is reflected by the polygon mirror 19, the fθ lens 20, the reflecting mirror 21, and the relay lens 22 in this order as indicated by an alternate long and dash lines A to thereby scan and selectively expose the surface of the photosensitive drum 27 of the process cartridge 17.

The process cartridge 17 includes the photosensitive drum 27, a Scorotron charger 29, a developing roller 31, a supply roller 33, a toner box 34, a transfer roller 30, a cleaning roller 51, and a secondary roller 52.

The photosensitive drum 27 is arranged beside the developing roller 31 with a rotation shaft of the photosensitive drum 27 in parallel with a rotation shaft of the developing roller 31 and is rotatable in the direction indicated by an arrow (counterclockwise direction in FIG. 2) in contact with the developing roller 31. The photosensitive drum 27 is a drum formed with a conductive base material. A charge generation layer and a charge transfer layer are formed on the conductive base material in this order. The charge generation layer includes a binder resin in which an organic photoelectric conductor is dispersed as a charge generation material. Examples of an organic photoelectric conductor include azo pigments and phthalocyanine pigments. The charge transfer layer includes a resin mixed with compounds. Examples of the compounds are hydrazone compounds and arylamine compounds. An example of the resin is polycarbonate. When the surface of the photosensitive drum 27 is exposed by a laser beam, the charge generation layer absorbs the light and generates a charge as a result. The charge is transferred onto the surface of the photosensitive drum 27 through the charge transfer layer. The charge reduces the surface potential from the charged value generated by charging operation of the Scorotron charger 29. As a result, a potential difference develops between exposed and non-exposed portions of the photosensitive drum 27. Therefore, an electrostatic latent image is formed on the photosensitive drum 27 by exposing and scanning the surface of the photosensitive drum 27 with a laser beam based upon image data.

The Scorotron charger 29 is disposed above the photosensitive drum 27 a predetermined distance apart therefrom so as not to come into contact with the photosensitive drum 27. The Scorotron charger 29 includes a tungsten wire, for example, for positively charging the surface of the photosensitive drum 27 to a uniform and positive polarity charge. The Scorotron charger 29 is turned ON/OFF by a charging power supply. An opening 171 is formed in the housing of the process cartridge 17 at a position near the Scorotron charger 29. The opening 171 brings the interior of the housing into fluid communication with the air outside from the housing and is for discharging ozone and other products generated at the time of charging to the outside of the process cartridge 17.

The developing roller 31 is disposed more downstream than the position where the Scorotron charger 29 is arranged with respect to rotating direction of the photosensitive drum 27 (counterclockwise direction in FIG. 2) and is made rotatable in a direction indicated by an arrow (clockwise direction in FIG. 2). The developing roller 31 includes a roller shaft made of metal coated with a roller made of a conductive rubber material, and a development bias is applied to the developing roller 31 from a not-shown development bias application power supply.

The supply roller 33 is disposed in a position beside the developing roller 31, which is a position on the opposite side of the photosensitive drum 27 across the developing roller 31. The supply roller 33 is in pressed contact with the developing roller 31. The supply roller 33 includes a metal roller shaft coated with a roller made from a conductive foam material. The supply roller 33 is adapted to triboelectrify toner supplied to the developing roller 31.

The toner box 34 is provided in a position beside the supply roller 33, and an inside thereof is filled with toner that is supplied to the developing roller 31 via the supply roller 33. In the embodiment, non-magnetic, single-component toner that tends to charge to a positive polarity is used as a developer. The toner is polymeric toner obtained by copolymerizing a polymeric monomer, for example, a styrene monomer such as styrene and an acrylic monomer such as acrylic acid, alkyl (C1 to C4) acrylate, or alkyl (C1 to C4) methacrylate with a well-known polymerization method such as suspension polymerization. In such a polymeric toner, a coloring agent such as carbon black or wax are compounded and an externally added agent such as silica is also added in order to improve fluidity. A particle diameter of the polymeric toner is approximately 6 to 10 $\mu$m.

An agitator 36 supported by a rotation shaft 35 provided in the center of the toner box 34. The agitator 36 rotates in a direction indicated by an arrow (counterclockwise direction in FIG. 2) to agitate the toner in the toner box 34. A window 38 for detection of a residual amount of toner is provided in a sidewall of the toner box 34 and is cleaned by a cleaner 39 supported by the rotation shaft 35.

The transfer roller 30 is disposed downstream from the developing roller 31 in the rotating direction of the photosensitive drum 27 and in a position below the photosensitive drum 27, and is rotatably supported in a direction indicated by an arrow (clockwise direction in FIG. 2). The transfer roller 30 includes a metal roller shaft coated with a roller made from an ion-conductive rubber material. A transfer bias application power supply (not shown) applies a transfer bias (transfer forward bias) to the transfer roller 30.

The cleaning roller 51 is disposed adjacent to the photosensitive drum 27 at a position downstream from the transfer roller 30 and upstream from the Scorotron charger 29 with respect to the rotating direction of photosensitive drum 27. The secondary roller 52 is provided in a position on the opposite side of the photosensitive drum 27 across the cleaning roller 51 in contact with the cleaning roller 51. A slide contact member 53 is disposed in abutment with the secondary roller 52.

In the laser printer 1, the photosensitive drum 27 is cleaned using a cleanerless system. That is, after the toner is transferred onto the sheet 3 from the photosensitive drum 27 by the transfer roller 30, residual toner and paper powder remaining on the surface of the photosensitive drum 27 are electrically attracted by the cleaning roller 51. Then, only the paper powder is electrically attracted by the secondary roller 52 from the cleaning roller 51, and the paper powder attracted by the secondary roller 52 is caught by the slide contact member 53.

An exposure window 69 is provided above the photosensitive drum 27 such that a laser beam from the scanner unit 16 is directly irradiated on the photosensitive drum 27. The exposure window 69 is an opening in the upper surface of the housing of the process cartridge 17 at a position that is closer to the toner box 34 than the opening 171 of the Scorotron charger 29. The exposure window 69 brings the photosensitive drum 27 into fluid communication with the outside of the process cartridge 17.

Figure 4:
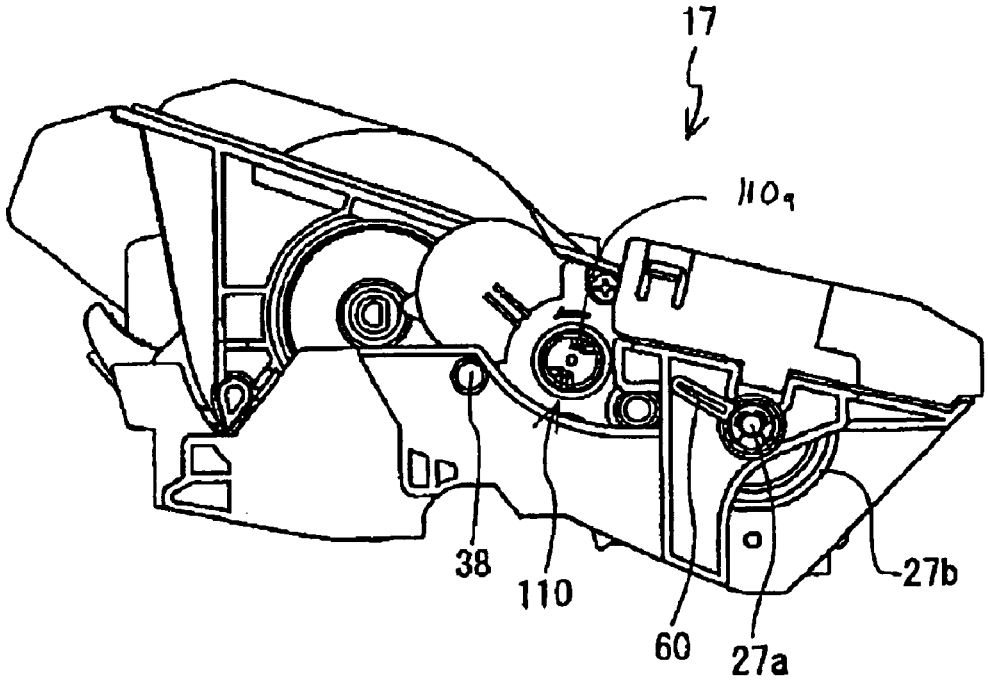
FIG. 4 is a side view showing a process cartridge of the image forming section.
Figure 7:
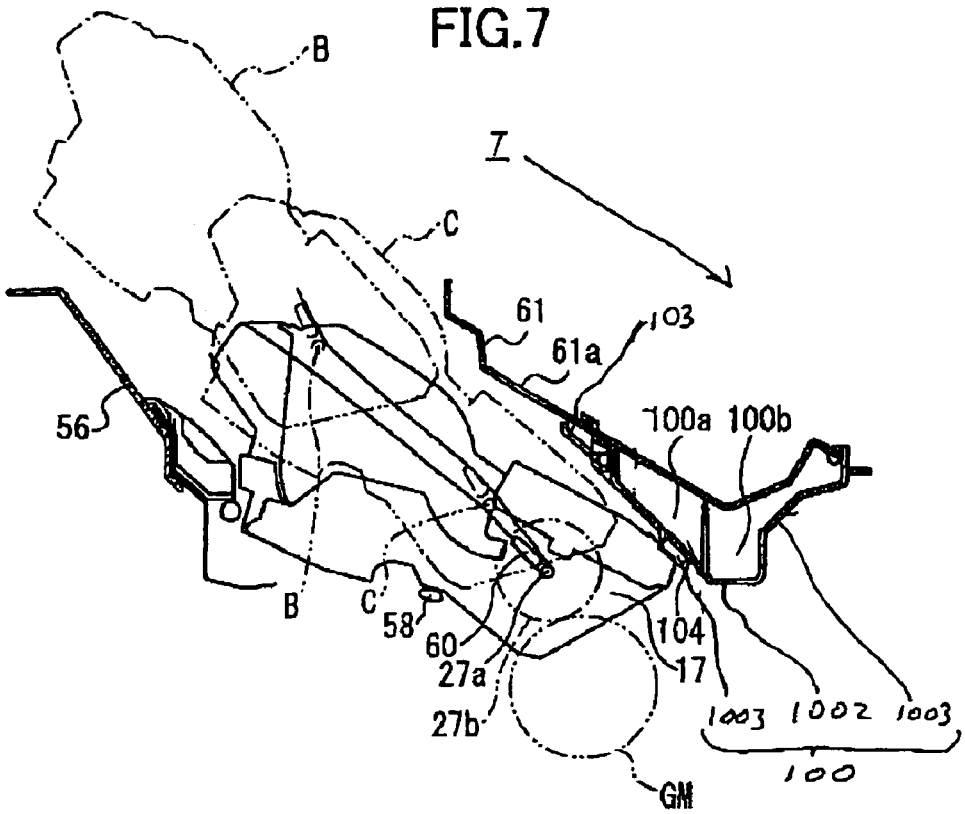
FIG. 7 is a view showing different stages of insertion of the process cartridge into the cartridge receiving section.

As shown in FIGS. 3 and 4, a rotation center shaft 27*a* serving as a drive shaft of the photosensitive drum 27 projects from both left and right sides of the housing of the process cartridge 17 and a transmission gear 27*b* is fixed to the rotation center shaft 27*a*. As shown in FIG. 4, a portion of the transmission gear 27*b* is exposed from one side of the housing of the process cartridge 17. As shown in FIG. 7, a drive gear GM is provided in the cartridge receiving section 57 and engages with the transmission gear 27*b* when the process cartridge 17 is mounted in the laser printer 1. The drive gear GM is driven to rotate by a power from a main motor (not shown). Returning to FIG. 4, guide plates 60 are provided in the vicinity of the rotation center shaft 27*a* on both sides of the housing of the process cartridge 17 and are adapted to guide the process cartridge 17 in an inserting direction so that the process cartridge 17 can be smoothly inserted into the receiving section 57. A driving force input section 110 is provided for transmitting drive force from another drive system (not shown) to drive rotation of the agitator 36 and the developing roller 31. The driving force input section 110 is provided in substantially the center on the side of the process cartridge 17 where the transmission gear 27*b* is provided. A cylindrical bearing portion 110*a* is formed in the driving force input section 110. The bearing portion 110*a* includes two projections on its inner wall. The projections face toward each other and the rotational axis of the driving force input section 110. The driving force input section 110 is provided on the right side of the process cartridge 17 with respect to an insertion direction I shown in FIG. 7 of the process cartridge 17 into the main body case 2.

A charge removing plate 107 is provided between the process cartridge 17 and the fixing device 18 on the conveying path of the sheet 3 so as to remove charges of the sheet 3 which can become charged by passing through the process cartridge 17 at the time of printing. The charge removing plate 107 functions as a sheet guide and as shown in FIG. 5 has a shape in which a plurality of grooves are provided in rows in the conveying direction of the sheet 3.

As shown in FIGS. 2 and 3, the fixing device 18 is disposed on a downstream side in a lateral direction of the process cartridge 17 and includes a heating roller 41, a pressing roller 42 for pressing the heating roller 41, and a pair of conveying rollers 43 which is provided on a downstream side of the heating roller 41 and the pressing roller 42. The heating roller 41 is a metal tubular roller and includes a halogen lamp for heating inside the tubular roller. The heating roller 41 pressurizes and heats toner transferred onto the sheet 3 in the process cartridge 17 to fix the toner onto the sheet 3 while the sheet 3 passes between the heating roller 41 and the pressing roller 42, thereafter conveying the sheet 3 to the sheet delivery path 44 by the conveying rollers 43.

The duct wall 100 is provided for exhausting air sucked through the fans 108*b* and 117 to outside of the main body case 2. The duct wall 100 forms a tubular exhaust passage that has a V shape in a side view. The duct wall 100 extends from left to right across the width of the process cartridge 17 in a width direction, which is perpendicular to the inserting direction of the process cartridge 17. As shown in FIG. 2, a partition wall 100*d* extends vertically from the duct wall 100 across the entire widthwise direction of the duct wall 100, thus dividing the duct wall 100 into two separate chambers: an ozone duct 100*a* and a heat duct 100*b*. The ozone duct 100*a* is for exhausting ozone and other gases generated by the Scorotron charger 29. The heat duct 100*b* is for exhausting air containing heat that was generated mainly by the fixing device 18.

Figure 5:
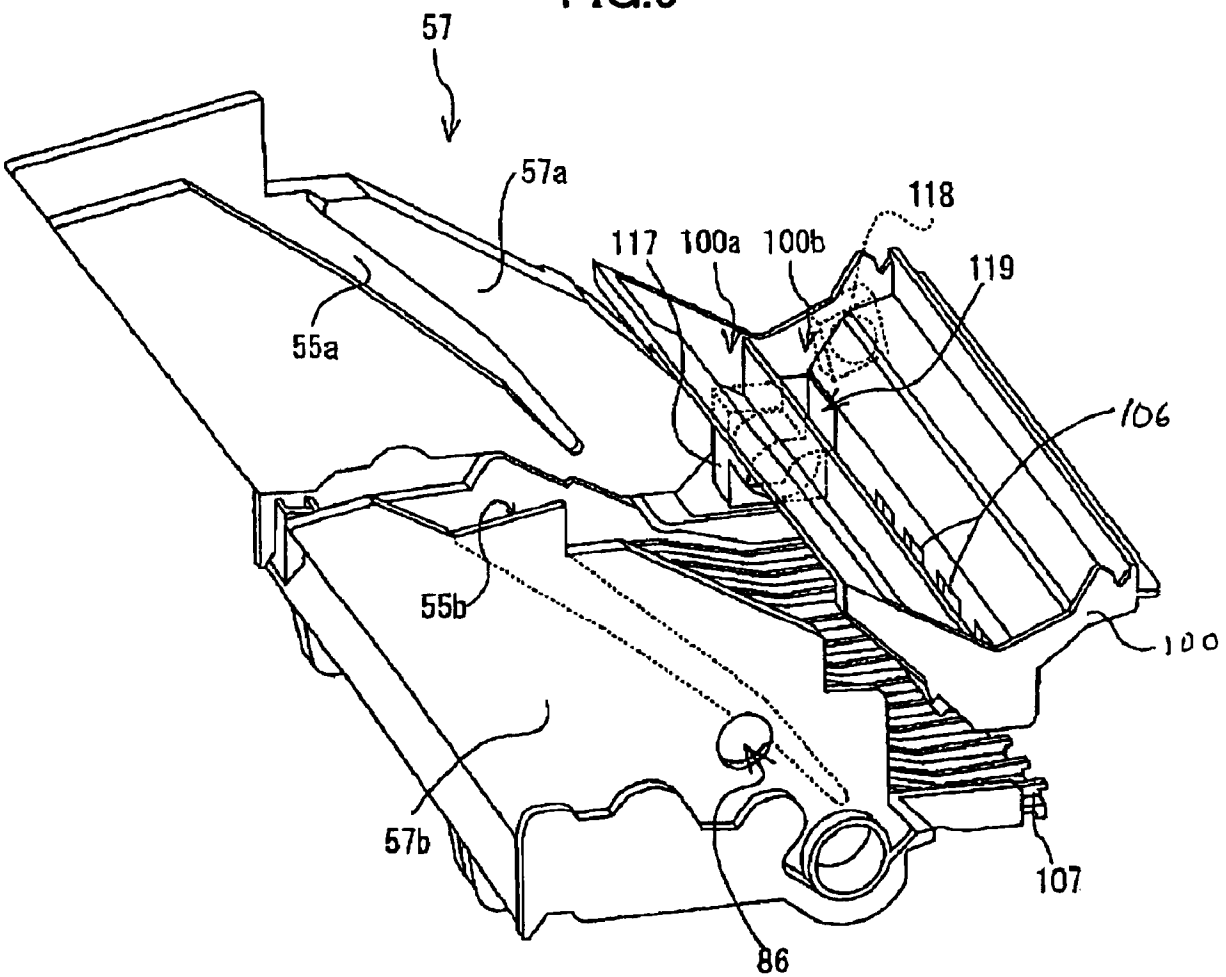
FIG. 5 is a perspective view showing a cartridge receiving section and a lower portion of a duct wall.
Figure 6:
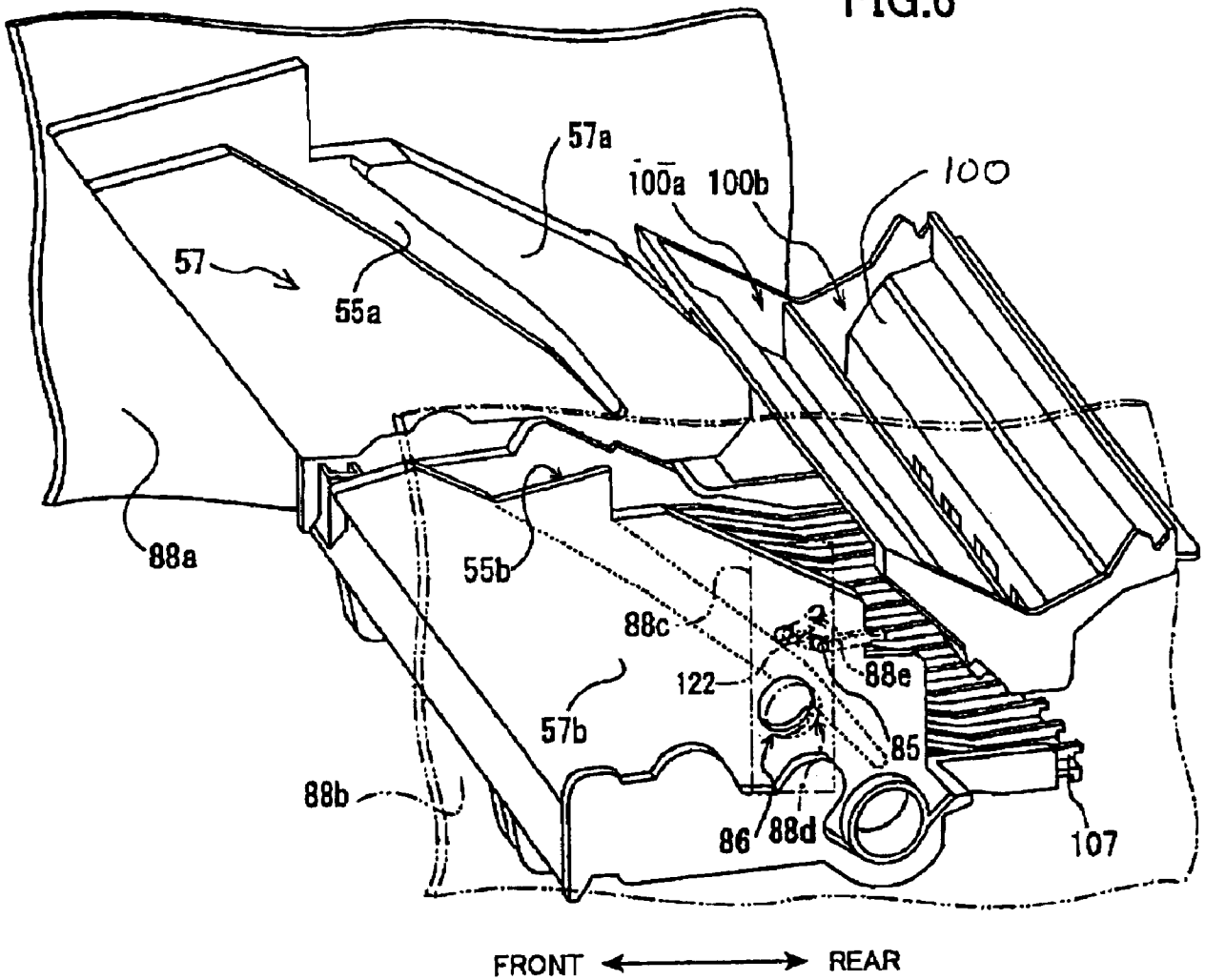
FIG. 6 is a perspective view similar to FIG. 5, but further showing location of a link mechanism for opening and closing a shutter ganged with a cover.

An exhaust chamber 101 is defined by the shutter 103, a lower wall surface of the ozone duct 100*a*, a resilient partitioning member 104, and left and right side surfaces 57*a*, 57*b* shown in FIGS. 5 and 6. When the process cartridge 17 is inserted in the main body case 2, the portion of the exhaust chamber 101 that is in the vicinity of the opening 171 provided in the vicinity of the Scorotron charger 29 on the upper surface of the housing of the process cartridge 17 is enclosed by the shutter 103, the lower wall surface of the ozone duct 100*a*, the partitioning member 104, the left side surface 57*a*, and the right side surface 57*b*. The left side surface 57*a* and a right side surface 57*b* are left and right side surfaces of the cartridge receiving section 57 to be described later. The partitioning member 104 is composed of a resilient member such as a rubber or sponge member. The exhaust chamber 101 is filled with the ozone generated by the Scorotron charger 29. An opening part 105 is formed in the lower surface of the duct wall 100 at a position opposed to the Scorotron charger 29. As will be described later, air containing the ozone is sucked and exhausted to the ozone duct 100*a* through the opening part 105.

Note that the partitioning member 104 is located on the lower surface of the ozone duct 100*a* portion of the duct wall 100 at a position where the downstream end of the process cartridge 17, with respect to the inserting direction of the process cartridge 17, abuts. Further the partitioning member 104 extends from left to right (direction perpendicular to the inserting direction) across the entire length of the duct wall 100. In addition to partially defining the exhaust chamber 101, the partitioning member 104 also functions as a cushioning material for absorbing shock when the process cartridge 17 is inserted.

Figure 8:
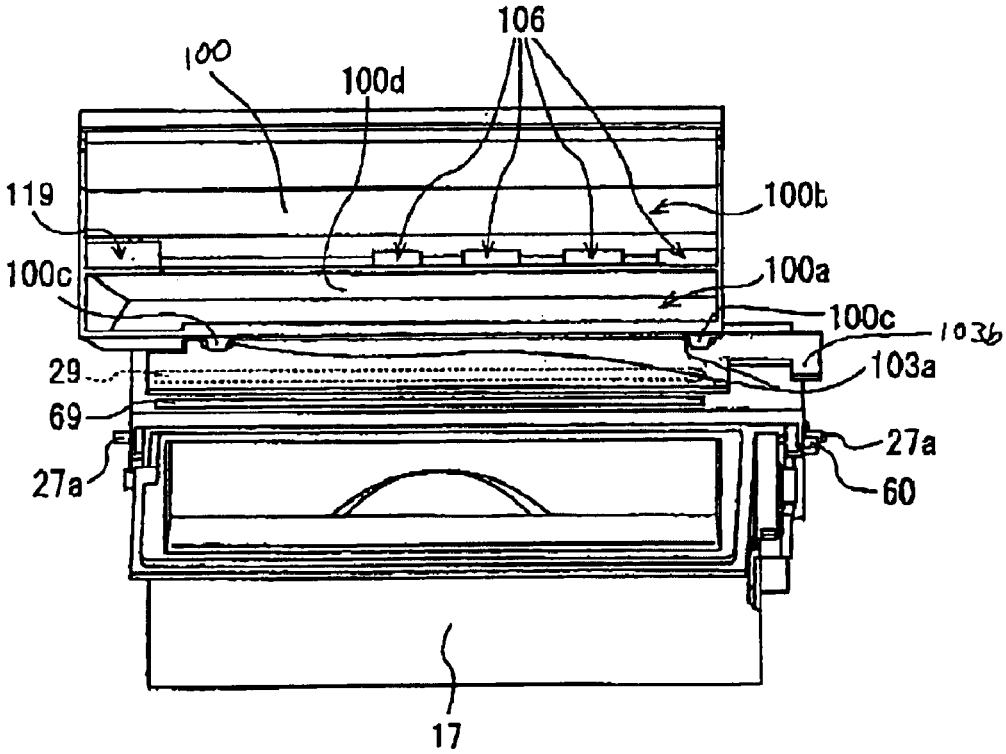
FIG. 8 is a partial plan view showing the shutter and surrounding components.

As shown in FIG. 8, the shutter 103 is a plate-shaped member elongated left to right in the width direction of the process cartridge 17 to a length substantially the same as the width from left to right sides of the process cartridge 17. Supporting portions 100*c* are provided on the lower surface of the ozone duct 100*a*. Shafts 103*a* are provided on one edge end of the shutter 103. The shafts 103*a* are supported by the supporting portions 100*c*. The shutter 103 is supported on the shafts 103*a* so that its free end extends upstream with respect to the inserting direction of the process cartridge 17. The supporting portions 100*c* support the shutter 103 such that the free end of the shutter 103 is vertically movable. As will be described later, the shutter 103 moves between an open position shown in FIG. 7 and a closed position shown in FIG. 2 in association with opening and closing movement of the upper surface cover 54. When the shutter 103 is in the closed position, the free end thereof is brought into contact with the process cartridge 17 at a position between the opening 171 for the Scorotron charger 29 and the exposure window 69.

Figure 9:
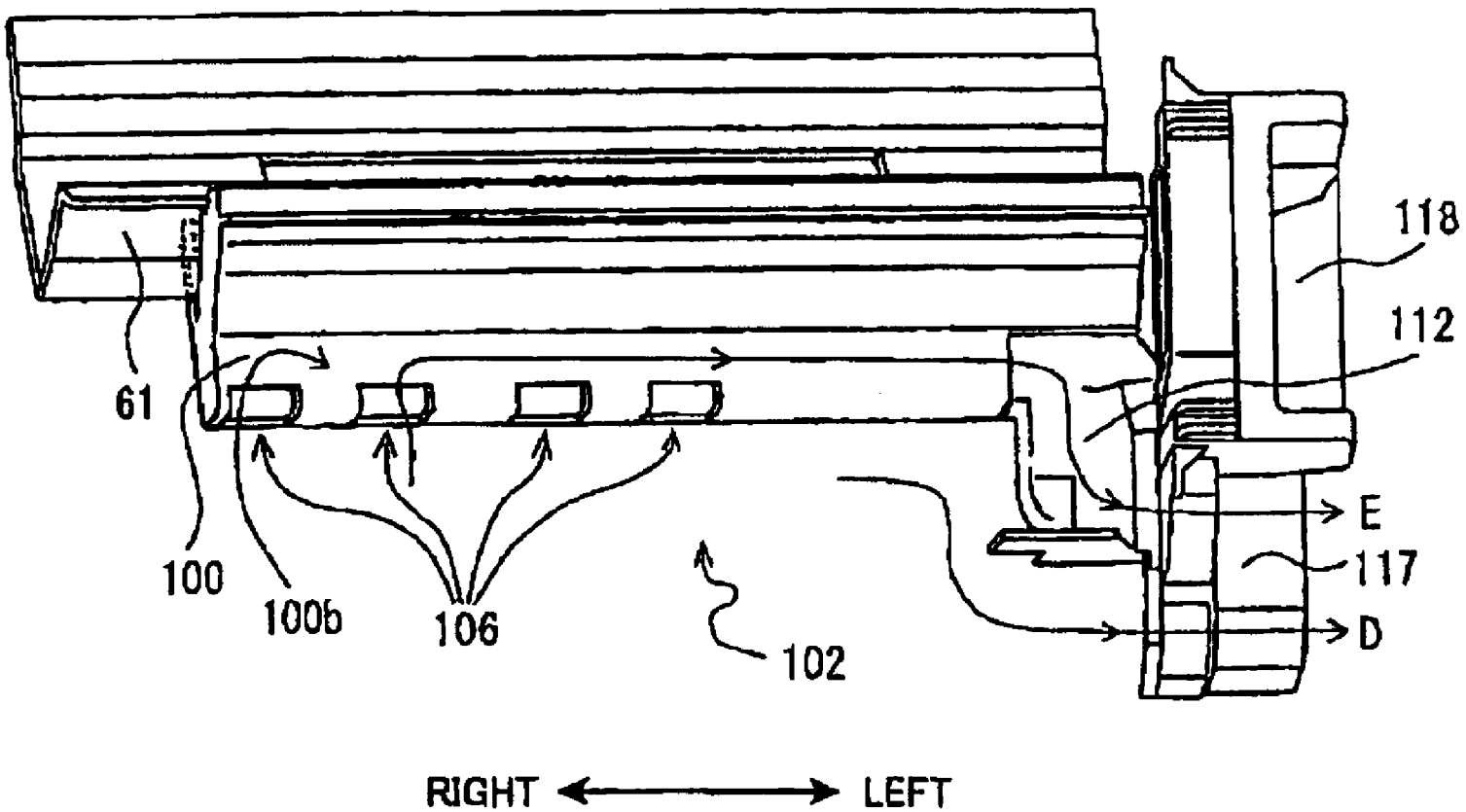
FIG. 9 is a perspective view showing flow of air from different areas of an exhaust chamber between the process cartridge and a fixing device.
Figure 10:
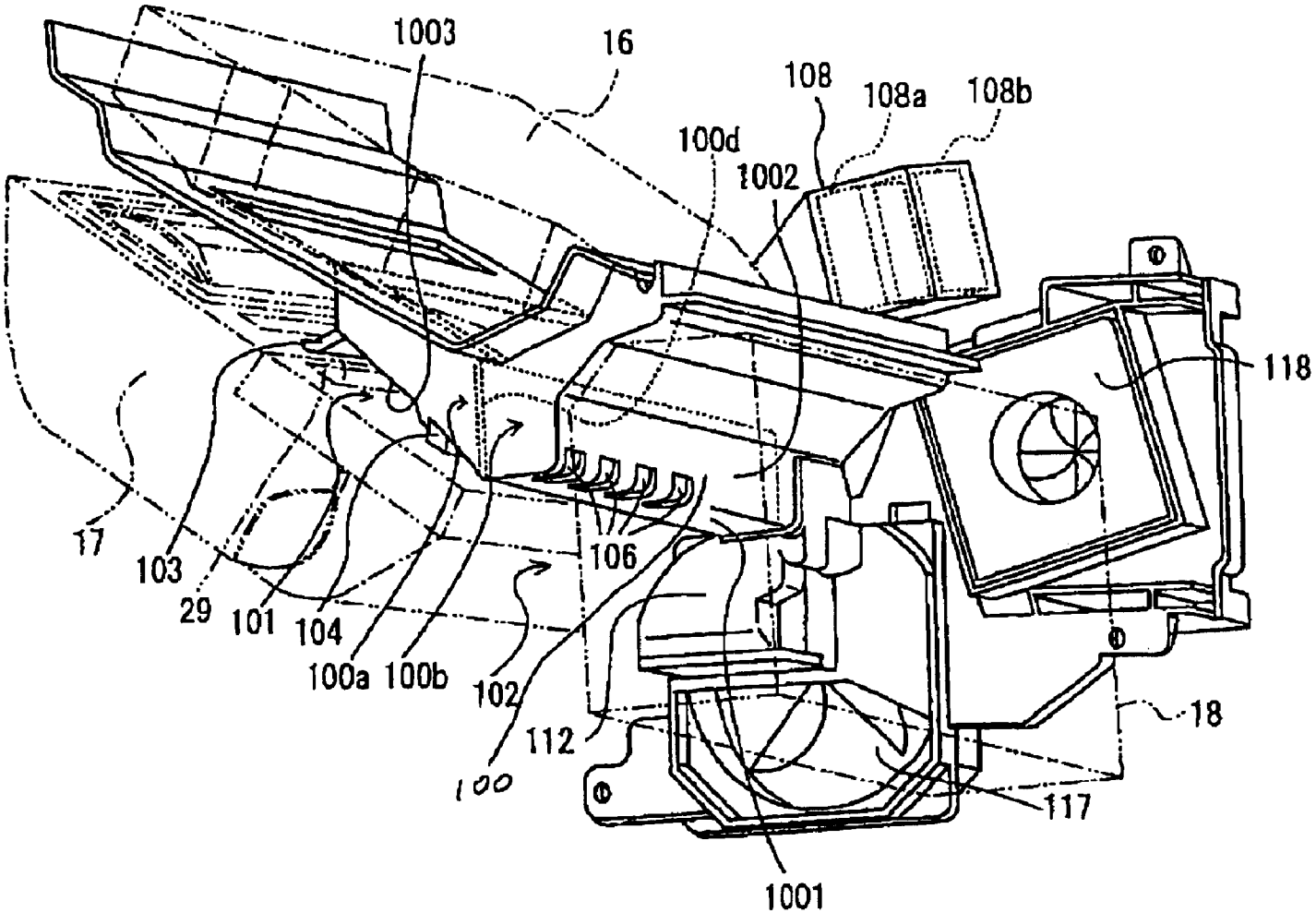
FIG. 10 is a perspective view from below looking slightly upward showing various fans and ducts around the exhaust chamber.

As shown in FIG. 10, the duct includes a cartridge-side wall section 1003 opposed to the process cartridge 17, a fixing-unit-side wall section 1002 opposed to the fixing device 18, and a connecting wall section 1001 that connects the cartridge-side wall section 1003 and the fixing-unit-side wall section 1002 together. As shown in FIGS. 2 and 9 to 11, four openings 106 are formed in the connecting wall section 1001 and the fixing-unit-side wall section 1002. As shown in FIG. 2, an exhaust chamber 102 is defined by the rear end of the inserted process cartridge 17 (the downstream end with respect to the inserting direction), the lower surface of the heat duct 100*b*, the fixing device 18, and the charge removing plate 107. The air in the exhaust chamber 102 is exhausted to outside the main body case 2 through the openings 106.

Figure 12:
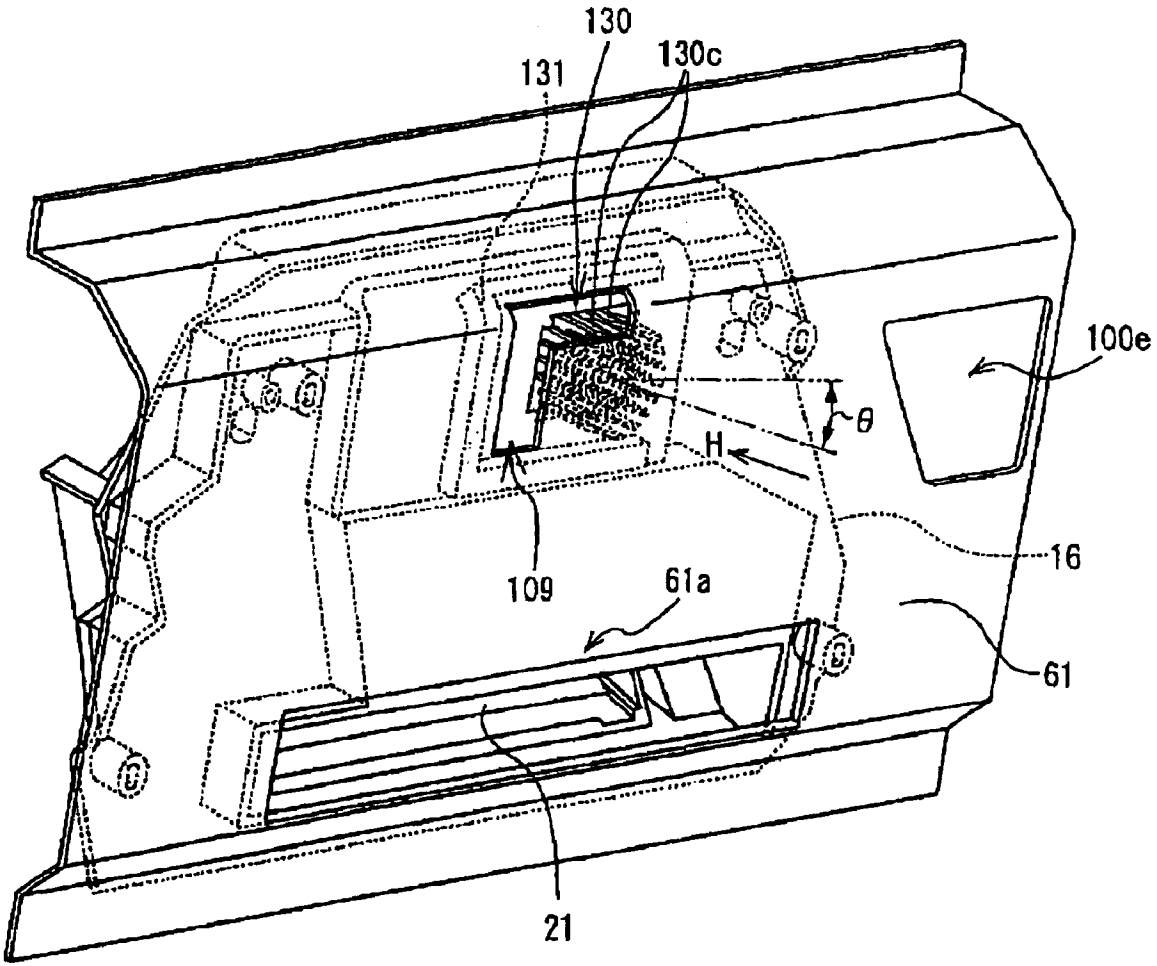
FIG. 12 is a perspective view showing an upper section of the duct wall from below.

As shown in FIGS. 2 and 12, the lower portion 61 of the scanner unit 16 is formed with an opening part 109 at a position where the heat sink 130 is opposed to the lower portion 61 of the scanner unit 16. The opening part 109 is opened astride the partition wall 100*d* so that both the ducts 100*a* and 100*b* are in fluid communication with the scanner unit 16. The heat sink 130 is exposed to a space between the scanner unit 16 and the lower portion 61 of the scanner unit 16 through an exposure port opened in a lower wall of the scanner unit 16. A sponge 131 is provided so as to encompass the heat sink 130 and the opening part 109 and substantially isolate the space in which the heat sink 130 is exposed from other open spaces of the scanner unit 16.

Figure 11:
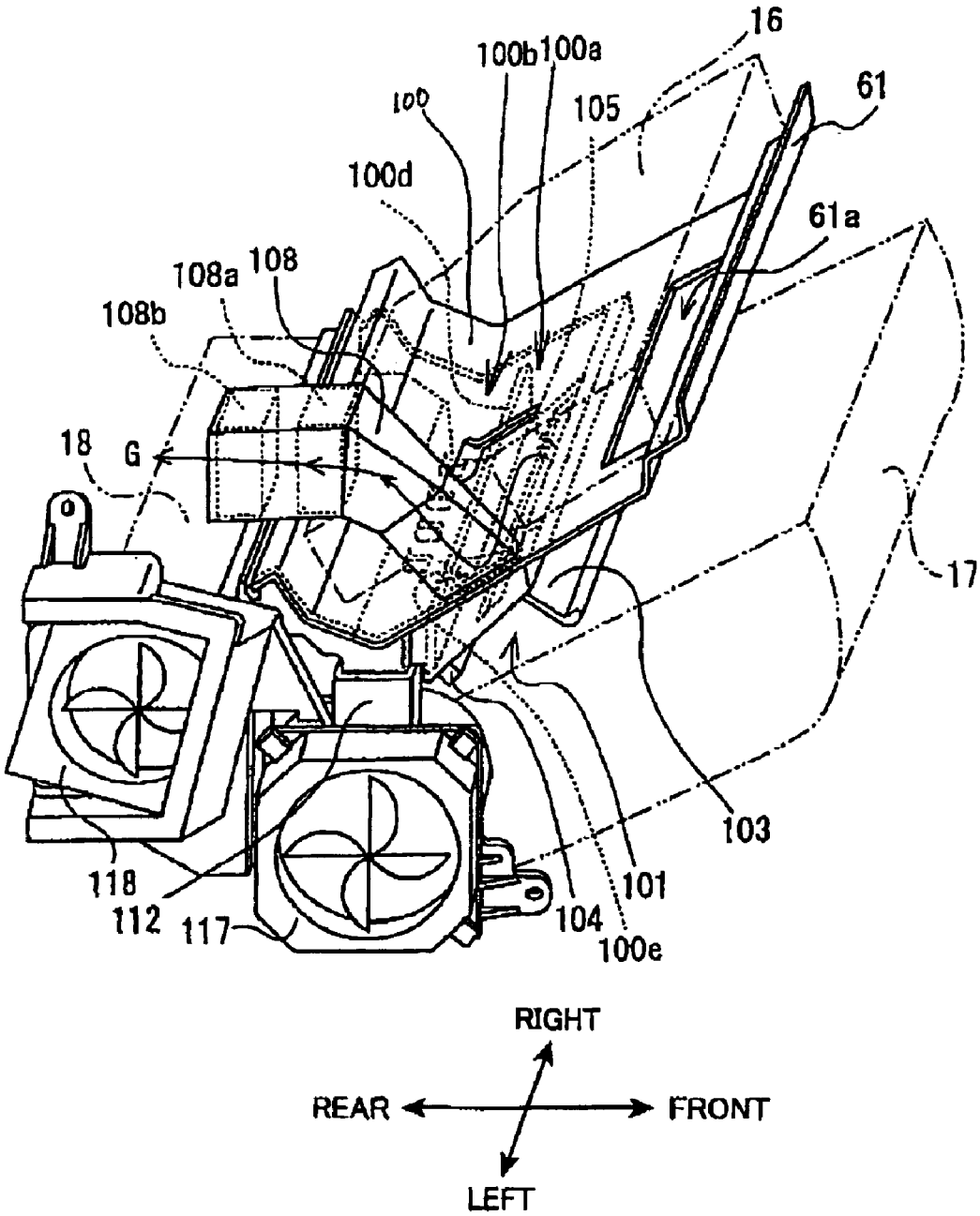
FIG. 11 is a perspective view from above looking slightly downward showing the various fans and ducts around the exhaust chamber.

As shown in FIGS. 11 and 12, a connection hole 100*e* is opened in the lower portion 61 of the scanner unit 16 at a position opposing the left side of the scanner unit 16. As shown in FIGS. 3 and 11, an exhaust pipe 108 communicating with air outside of the main body case 2 is attached around the connection hole 100*e*. The fan 108*b* and the ozone filter 108*a* are disposed at a downstream end of the exhaust pipe 108 with respect to an exhaust flow direction of air movement generated as the fan 108*b* for sucks air from the exhaust chamber 101 and exhausts the air to the outside of the main body case 2. At this time, the ozone filter 108*a* removes ozone contained in the air.

The cartridge receiving section 57 serves as a receiving section of the process cartridge 17 of the main body case 2. The cartridge receiving section 57 will next be described in more detail with reference to FIGS. 1 and 5 to 7.

As shown in FIGS. 1 and 6, a space is provided in between a front plate 2*a* of the main case 2, a main body frame left side surface 88*a*, and a main body frame right side surface 88*b*. The space is continuous with the opening formed in the upper surface of the main body case 2 at a position in front of the sheet discharge tray 46. The cartridge receiving section 57 is defined by a bottom surface 56 (shown in FIG. 1), a portion of the lower portion 61, the ozone duct side of the wall 100, the left side surface 57*a*, and the right side surface 57*b*.

The bottom surface 56 is formed so as to slant downward in the manner of a slide to the rear in substantially the same direction as guide grooves 55*a* and 55*b* shown in FIGS. 6 and 7. The portion of the lower portion 61 that forms the upper inner wall of the cartridge receiving section 57 extends in an inclined shape, with the front side higher than the rear side, from near the ozone duct 100*a* to near the shaft 54*a* of the upper surface cover 54. The lower portion 61 supports the scanner unit 16 and is provided with a slit-shaped window 61*a* extending left to right in the width direction (the direction perpendicular to the inserting direction) of the process cartridge 17 such that the laser beam generated by the scanner unit 16 irradiates on the surface of the photosensitive drum 27 of the process cartridge 17.

The main body case 2 further includes a main body frame made of metal, which includes a main body frame left side surface 88*a* and a main body frame right side surface 88*b* shown in FIG. 6. The main body frame supports various units of the laser printer 1. The receiving section left side surface 57*a* and the receiving section right side surface 57*b* are made of resin and provided on the inner surface sides of the main body frame left and right side surfaces 88*a* and 88*b*. The inner surface sides of the receiving section left side surface 57*a* and the receiving section right side surface 57*b* define the sides of the cartridge receiving section 57. The guide grooves 55*a* and 55*b* are provided on the left side surface 57*a* and the right side surface 57*b* and have slant downward and rearward from the main body case front plate 2*a* side toward an image formation position below the scanner unit 16. The pair of left and right guide grooves 55*a* and 55*b* are each formed in an exaggerated U-shaped groove in a side view. The rotation center shaft 27*a* of the photosensitive drum 27 projects from the left and right sides of the process cartridge 17 in between upper and lower surfaces of the grooves 55*a*, 55*b* at a lower end of the guide grooves 55*a*, 55*b*. The lower ends of the guide grooves 55*a*, 55*b* define the position where insertion of the process cartridge 17 is stopped.

Figure 14:
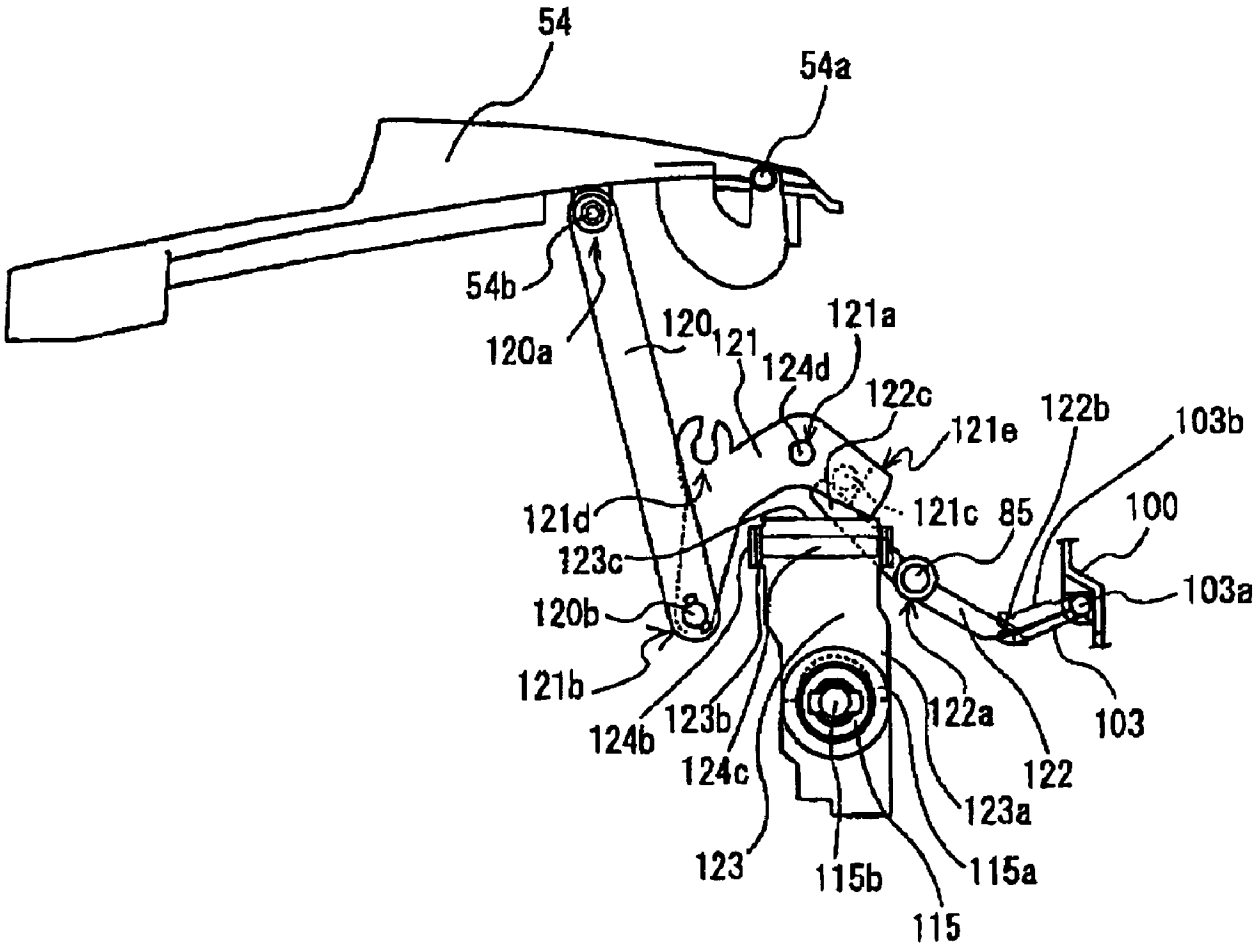
FIG. 14 is a side view showing the link mechanism.
Figure 15:
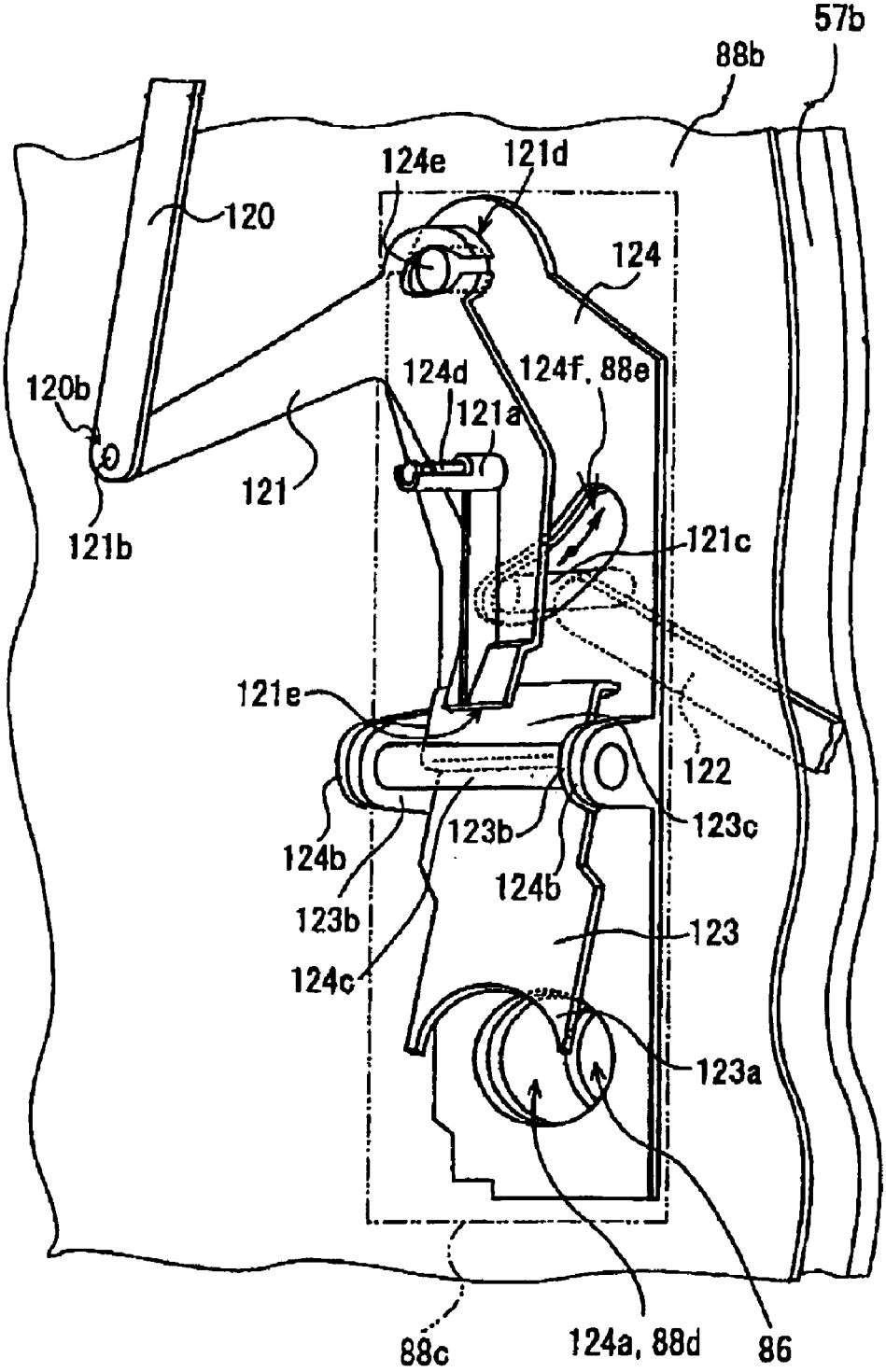
FIG. 15 is a perspective view showing the link mechanism.

As shown in FIG. 6, a link mechanism is disposed on the inner (left) and outer (right) surfaces of the right side surface 57*b*. As shown in FIGS. 14 and 15, the link mechanism includes a first link 120, a cam plate 121, a second link 122, an advance and retract plate 123, and a link holder 124.

Figure 13:
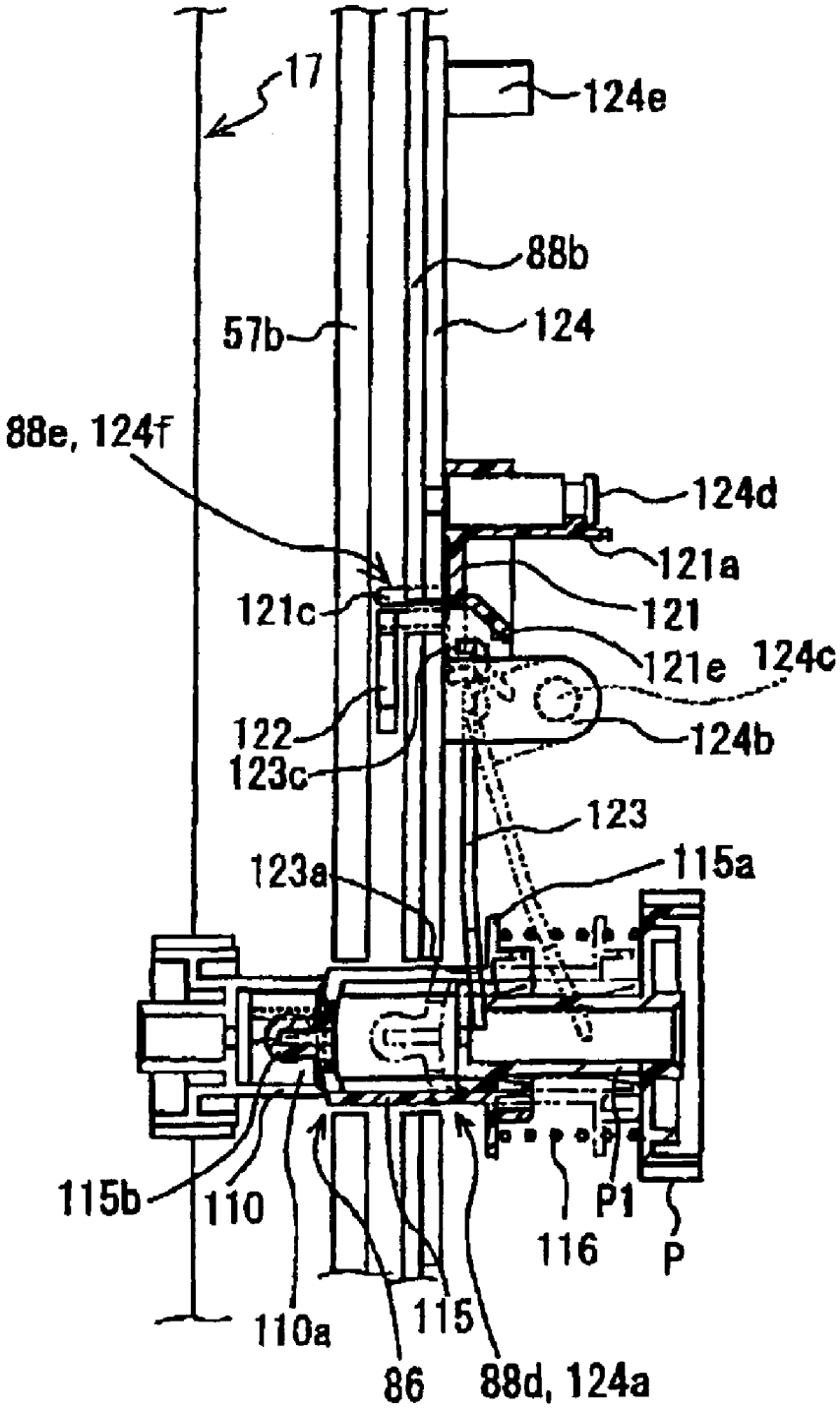
FIG. 13 is a side sectional view showing operation of a driving force output section that is advanced and retracted by the link mechanism.

Various projections for engaging with components of the link mechanism are formed on to the inner (left) and outer (right) surfaces of the right side surface 57*b*. A through-hole 86 that penetrates through of the right side surface 57*b* is provided at a position upstream at the closed insertion stop end of the guide groove 55*b*. As shown in FIG. 13, the driving force input section 110 of the process cartridge 17 and advance and retract through the through-hole 86 into and out of engagement with a driving force output section 115 for imparting a driving force to the developing roller 31.

A pin 85 for supporting the second link 122 of the link mechanism protrudes from the outer surface of the receiving section right side surface 57*b*, that is from the surface opposed to the main body frame right side surface 88*b*. The pin 85 is arranged slightly to the rear end side of the main body case 2 vertically above the through-hole 86. The pin 85 engages with a bearing 122*a* (shown in FIG. 14) of the second link 122 to support the second link 122 such that the second link 122 is pivotable at a position between the receiving section right side surface 57*b* and the main body frame right side surface 88*b*.

As shown in FIG. 15, a fixing section 88*c* for fixing the link holder 124 is provided on an outer surface side of the main body frame right side surface 88*b*, that is, the surface side opposed to the side surface of the main body case 2. The link holder 124 supports the cam plate 121 and the advance and retract plate 123. The fixing section 88*c* is provided with a through-hole 88*d* that penetrates through of the main body frame right side surface 88*b*. The through-hole 88*d* is provided in a position opposed to the through-hole 86 of the receiving section right side surface 57*b* such that the driving force output section 115 can advance and retard through the through-hole 88*d* and the through-hole 86. The through-hole 88*d* is provided at a position opposed to the through-hole 86. A slide hole 88*e* is provided above the through-hole 88*d*. The slide hole 88*e* is formed in a curved oval shape and is opened so that a pin 121*c* of a cam plate 121 to be described later can project to between the main body frame right side surface 88*b* and the receiving section right side surface 57*b*.

Next, the process for inserting the process cartridge 17 will be described with reference to FIG. 7. First, the process cartridge 17 in positioned as indicated by two-dot chain line B in FIG. 7. At this point, the left and right side ends of the rotation center shaft 27*a* are inserted and dropped in the guide grooves 55*a* and 55*b* with the photosensitive drum 27 side of the process cartridge 17 as the front. Also, the guide plates 60 are also inserted in the guide grooves 55*a* and 55*b*. Then, the bottom of the process cartridge 17 is slid across the bottom surface 56, until the process cartridge 17 is guided obliquely downward to the position indicated by two-dot chain line C.

Then, once the rotation center shaft 27*a* is supported at the insertion stop position of the guide grooves 55*a* and 55*b*, the bottom part of the process cartridge 17 slides off the bottom surface 56 and pivots downward (counterclockwise direction in the FIG. 1) around the rotation center shaft 27*a* until the bottom surface of the process cartridge 17 abuts against a supporting portion 58. This pivoting movement brings the front end of the process cartridge 17 into abutment against the partitioning member 104 so that the process cartridge 17 is stabilized without being subjected to any warping force.

As shown in FIG. 8, an L-shaped hook portion 103*b* projects from a right side of the shutter 103 following an imaginary axial line of the shafts 103*a*. One end of the second link 122 abuts against the hook portion 103*b* to open the shutter 103. When the shutter 103 is closed, shutter 103 is indicated as indicated by solid line with the free end of the shutter 103 in contact with the process cartridge 17 at a position between the opening part of the Scorotron charger 29 and the exposure window 69. When the shutter 103 is opened, the free end is moved upward so that the shutter 103 rotates into the orientation shown in two-dot chain line in FIG. 16, that is, substantially parallel with the lower portion 61 of the cartridge receiving section 57.

Next, the link mechanism for opening and closing movement of the shutter 103 in association with opening and closing of the upper surface cover 5 will be described in upper portion 61 of the duct wall 100 more detail with reference to FIGS. 8 and 14 to 17. The link holder 124 is a metal plate body of a substantially long plate shape. The link holder 124 is fixed to the fixing section 88*c* of the main body frame right side surface 88*b* by tightening means such as a screw. The link holder 124 supports the cam plate 121 and the advance and retract plate 123 in a predetermined positional arrangement on the main body frame right side surface 88*b*. A through-hole 124*a* and a lock pin 124*e* are provided on opposite longitudinal (vertically separated) ends of the link holder 124. The through hole 124*a* is opened at a position corresponding to the through-hole 88*d* of the main body frame right side surface 88*b* and the through-hole 86 of a receiving section right side surface 57*b*, so that the driving force output section 115 can advance and retract through the through-hole 124*a*, the through-hole 88*d*, and the through-hole 86. The lock pin 124*e* is provided closer to one latitudinal edge of the link holder 124 and protrudes away from the link holder 124 in a direction substantially perpendicular to the surface of the link holder 124.

Moreover, two shaft support plates 124*b* extend from the link holder 124 in substantially the same direction as the lock pin 124*e*. The shaft support plates 124*b* are located at positions at longitudinal edges of, and substantially at the longitudinal middle of, the link holder 124. The free edges of the shaft support plates 124*b* have an oval shape. A rotation shaft 124*c* extends latitudinally across the link holder 124 between surfaces of the shaft support plates 124*b*. A cam shaft 124*d* is protrudes in substantially the identical direction with the lock pin 124*e* in substantially the middle position between the shaft support plates 124*b* and the lock pin 124*e*. A slide hole 124*f* having the same curved oval shape as the slide hole 88*e* is opened at a position that corresponds to the position of the slide hole 88*e* in between the shaft support plates 124*b* and the cam shaft 124*d*. When the link holder 124 is fixed onto the fixing section 88*c*, the pin 121*c* of the cam plate 121 protrudes between the main body frame right side surface 88*b* and the receiving section right side surface 57*b*, and further through the slide hole 124*f* and the slide hole 88*e*, and into engagement with the cam shaft 124*d*.

The first link 120 is an elongated flat plate with a bearing 120*a* at one end and a bearing 120*b* at the other. The bearing 120*a* pivotably engages with a shaft 54*b* provided on one side surface of the upper cover 54 (side surface to the right side of the main body case 2). The bearing 120*b* pivotably engages with a shaft 121*b* provided at an end of the cam plate 121.

The cam plate 121 is a substantially C-shaped flat plate, including an elongated back plate formed at either end integrally with an elongated side plate. The shaft 121*b* is provided at the free tip of one side plate. An outward protruding locking portion 121*d* is formed integrally at the joint between the back plate and the side plate provided with the shaft 121*b*. As shown in FIG. 15, the locking portion 121*d* nips and engages with the lock pin 124*e* when the upper surface cover 54 is opened. This maintains the opened state of the upper surface cover 54. A bearing 121*a* is provided at the joint between the back plate portion and the other side plate portion. The bearing 121*a* is mounted on the pin 124*d* of the link holder 124, so that the cam plate 121 is pivotable around the bearing 121*a*. The pin 121*c* extends from the cam plate 121 and through the slide holes 124*f*, 88*e* to a position where it abuts against and pivots the second link 122 in association with opening movement of the upper surface cover 54. The tip end of the this side plate portion of the cam plate 121 is bent away from the link holder 124 to form a slope 121*e* that abuts against the advance and retract plate 123.

The second link 122 is a flat plate with a slight L shape. The second link 122 includes the bearing 122*a* at the bent part of the L shape. The bearing 122*a* engages with the pin 85 of the receiving section right side surface 57*b*, and so is pivotable around the pin 85 at a position between the main body frame right side surface 88*b* and the receiving section right side surface 57*b*. The second link 122 includes a contact part 122*c* at one tip and a protrude and contact portion 122*b* at the opposite tip. When the link holder 124 is fixed to the fixing section 88*c* of the main body frame right side surface 88*b*, the pin 121*c* projects through the slide holes 124*f* and 88*e* and imparts a pressing force on the contact part 122*c*. The protrude and contact portion 122*b* extends following the longitudinal direction of the second link 122 and abuts against the hook portion 103*b* of the shutter 103. Therefore, the shutter 103 is opened by the pressing force transmitted by the second link 122.

The advance and retract plate 123 has a substantially rectangular plate shape. The advance and retract plate 123 is formed with an engaging portion 123*a* at one longitudinal end and a protrude and contact portion 123*c* and the opposite longitudinal end. The engaging portion 123*a* is formed in a semicircular shape for advancing and retracting the driving force output section 115. The protrude and contact portion 123*c* is formed following the width of the advance and retract plate 123 in a C-shape as viewed in FIG. 13. The open portion of the groove faces the link holder 124. Two bearings 123*b* extend from the surface of the advance and retract plate 123 in a direction perpendicular to a plate surface of the advance and retract plate 123. The two bearings 123*b* each have a plate shape with a free end in an oval shape. The bearings 123*b* are located at opposite widthwise side edges of the advance and retract plate 123. A circular hole is formed in the center of each of the bearings 123*b*. The rotation shaft 124*c* of the link holder 124 penetrates through the circular hole and supports the advance and retract plate 123 in a pivotable manner. When the slope 121*e* of the cam plate 121 abuts against and presses down on the protrude and contact portion 123*c*, the engaging portion 123*a* moves away from the link holder 124 with the rotation shaft 124*c* as a fulcrum.

Note that as shown in FIG. 13, the driving force output section 115 is formed as a cylindrical hollow tubular body. The driving force output section 115 is movable in the axial direction of a drive shaft P1. The drive shaft P1 is integrally formed with a second drive gear P, which is rotated by a drive source (not show) of the printer 1. The driving force output section 115 is fitted on the drive shaft P1 so as to rotate integrally with the drive shaft P1. A pair of projections (only one shown in FIG. 13) are provided at the tip end 115*b* of the driving force output section 115. When the driving force output section 115 engages with the bearing portion 110*a* of the driving force input section 110, the projections at the tip end 115*b* abut against a projection of the bearing portion 110*a* and supply a rotation driving force to the driving force input section 110. The driving force output section 115 is movable forward and backward so as to engage with and disengage from the driving force input section 110 through the through-hole 86 opened in the receiving section right side surface 57*b* of the cartridge receiving section 57. A flange 115*a* is provided around the outer external periphery of the cylindrical tube body of the driving force output section 115. A spring 116 is disposed around the drive shaft P1 between the flange 115*a* and the second drive gear P. The spring 116 constantly urges the flange 115*a* to move toward the cartridge receiving section 57. Therefore, the tip end 115*b* projects from the through-hole 86 of the receiving section right side surface 57*b*. The engaging portion 123*a* of the advance and retract plate 123 is in contact with the flange 115*a* from a side opposite to the side biased by the spring 116. The engaging portion 123*a* presses the flange 115*a* when the advance and retract plate 123 pivots, whereby the tip end 115*b* is retracted against a biasing force of the spring 116.

Next, a scanner section 135 in which the polygon mirror 19 of the scanner unit 16 and the heat sink 130 are fixed on a substrate 132 will be described with reference to FIGS. 12 and 18 to 22.

Figure 18:
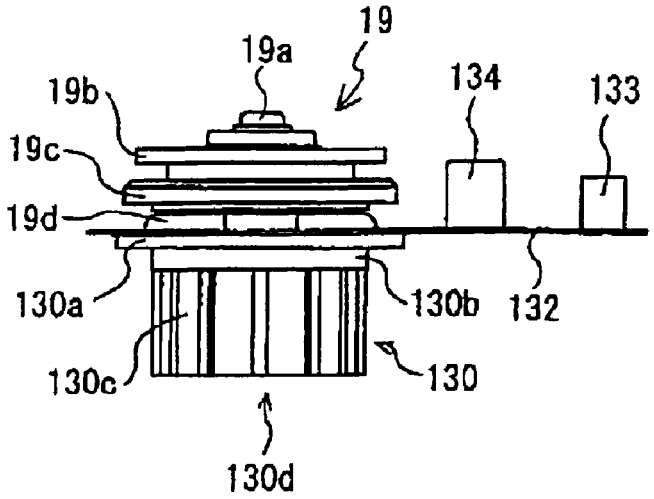
FIG. 18 is a side view of a scanner section.
Figure 19:
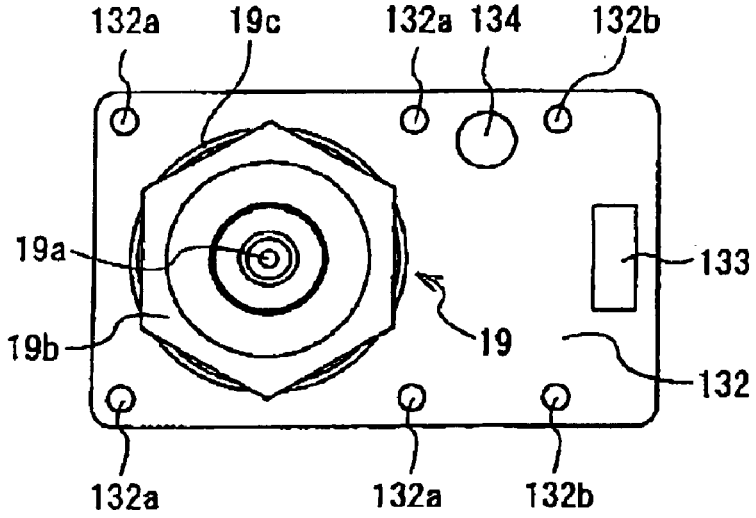
FIG. 19 is a plan view of the scanner section.
Figure 20:
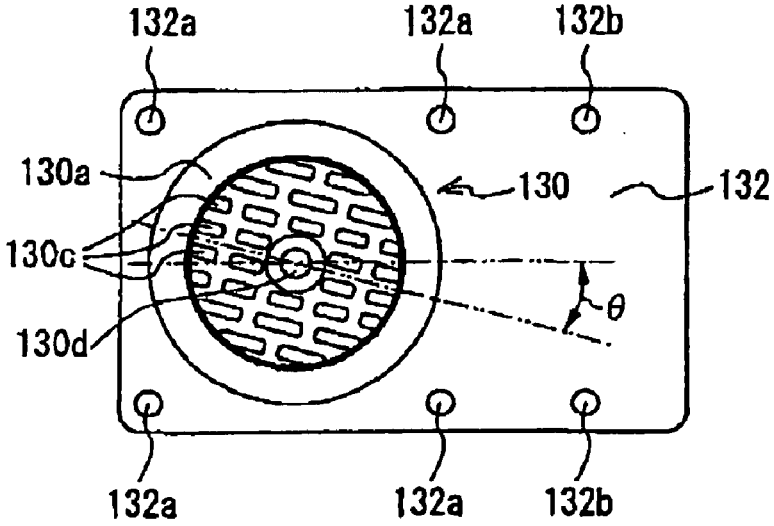
FIG. 20 is a bottom view of the scanner section.

As shown in FIGS. 18 to 20, the scanner section 135 has a structure in which the substrate 132 is sandwiched by the polygon mirror 19 and the heat sink 130 from its upper and lower sides in a side view. The polygon mirror 19 has a equilateral hexagonal shape in a plan view. The polygon mirror 19 includes a mirror section 19*b*, a motor 19*c*, and a coil 19*d*. The mirror section 19*b* is formed on all six sides with reflecting mirrors for reflecting the laser beam in a horizontal direction. The motor 19*c* is for generating a driving force to rotate the mirror section 19*b*. The coil 19*d* is for generating an electromagnetic force for the driving force of the motor 19*c*. A screw 19*a* is provided in a vertical direction so as to be a center shaft for the rotation of the mirror section 19*b*. The heat sink 130 is an integrally formed product of aluminum die-cast. The heat sink 130 includes a flange section 130*a*, heat radiation fins 130*c*, and a base 130*b*. The flange section 130*a* extends horizontally beyond the edges of the coil 19*d* so that heat generated from the coil 19*d* and conducted via the substrate 132 is efficiently conducted through the flange section 130*a*. The heat radiation fins 130*c* are for radiating the conducted heat into the air. The base 130*b* is for connecting the heat radiation fins 130*c* to the flange section 130*a*. A screw 130*d* engages with a screw hole (not shown) in the screw 19*a* of the polygon mirror 19 through a through-hole opened in a center of the under side of the heat sink 130, whereby the polygon mirror 19 and the heat sink 130 are fixed to the substrate 132.

A silicon-based adhesive having a high thermal conductivity is applied to a surface on the substrate 132 side of the flange section 130*a* of the heat sink 130, whereby the fixing of the heat sink 130 tightened to the substrate 132 with one screw is reinforced. The surface area where the heat sink 130 and the substrate 132 contact each other can be increased when the adhesive fill gaps in the flange section 130*a*. This increases thermal conductivity.

The beat radiation fins 130*c* are provided protrudingly from the base 130*b* and each has a plate shape that extends in a direction perpendicular to a surface direction of the flange section 130*a*. All of the heat radiation fins 130*c* are oriented in the same direction. More specifically, the heat sink 130 is fixed to the substrate 132 such that the heat radiation fins 130*c* form an angle θ with respect to a longitudinal direction of the substrate 132. The purpose of this angle θ will be described later.

The substrate 132 is a wiring substrate made from iron or other metal having high thermal conductivity. The substrate 132 has a rectangular shape in a plan view. The polygon mirror 19 and the heat sink 130 are fixed close to one longitudinal end of the substrate 132, and a connector 133 and a capacitor 134 are provided at the other longitudinal end. The polygon mirror 19, the heat sink 130, and the connector 133 are centered in a latitudinal direction of the substrate 132. The connector 133 is receives a signal for driving the motor 19*c*. Moreover, screw holes 132*a* and 132*b* for fixing the scanner section 135 to the scanner unit 16 with screws are provided along edge parts of the substrate 132. Four screw holes 132*a* are provided in positions which are arranged axially symmetrical around a rotation center axis of the polygon mirror 19. The screw holes 132*b* are provided on a side where the connector 133 is provided in the longitudinal direction of the substrate 132.

Figure 21:
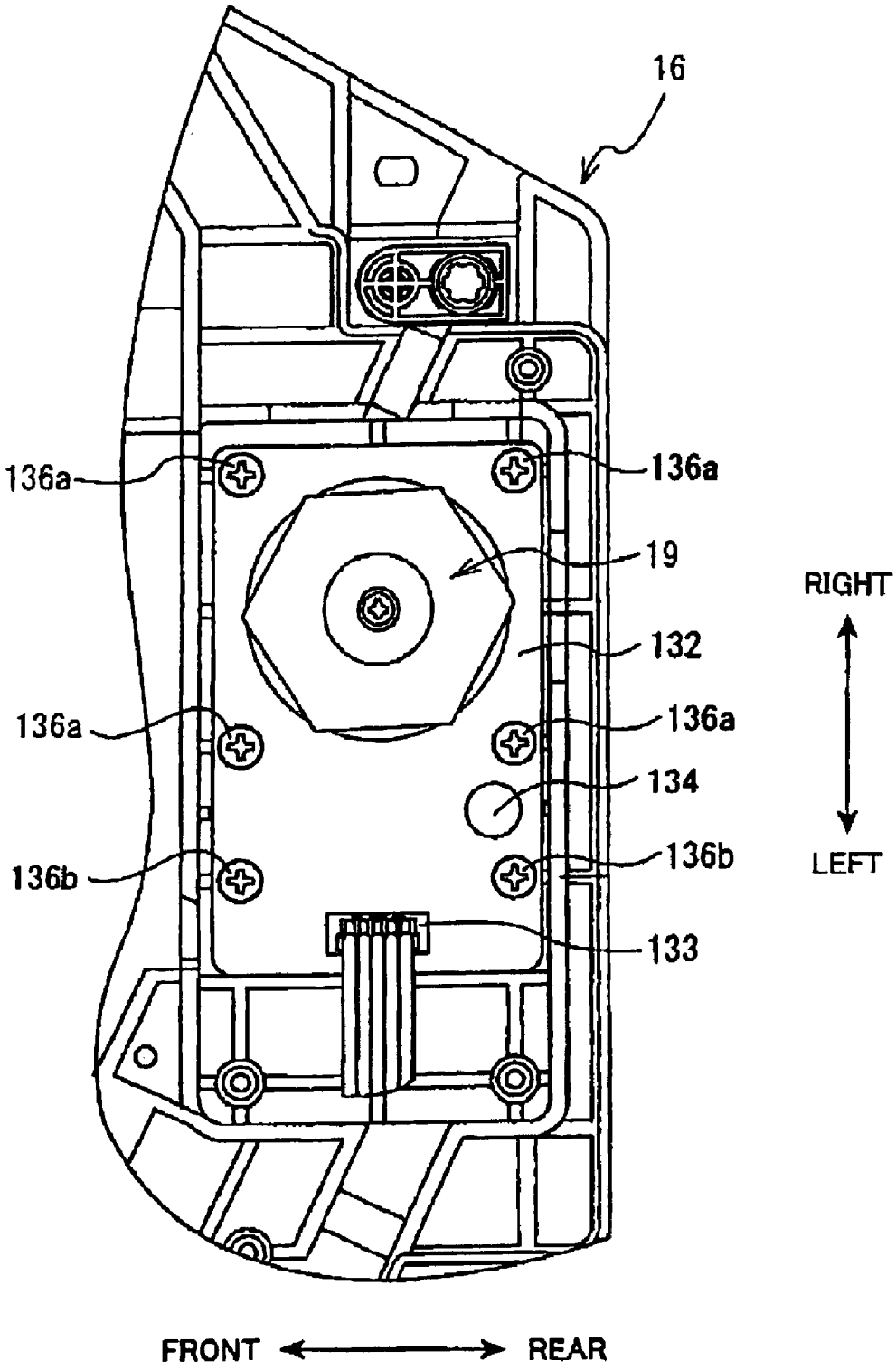
FIG. 21 is a plan view of the scanner section fixed to a scanner unit.
Figure 22:
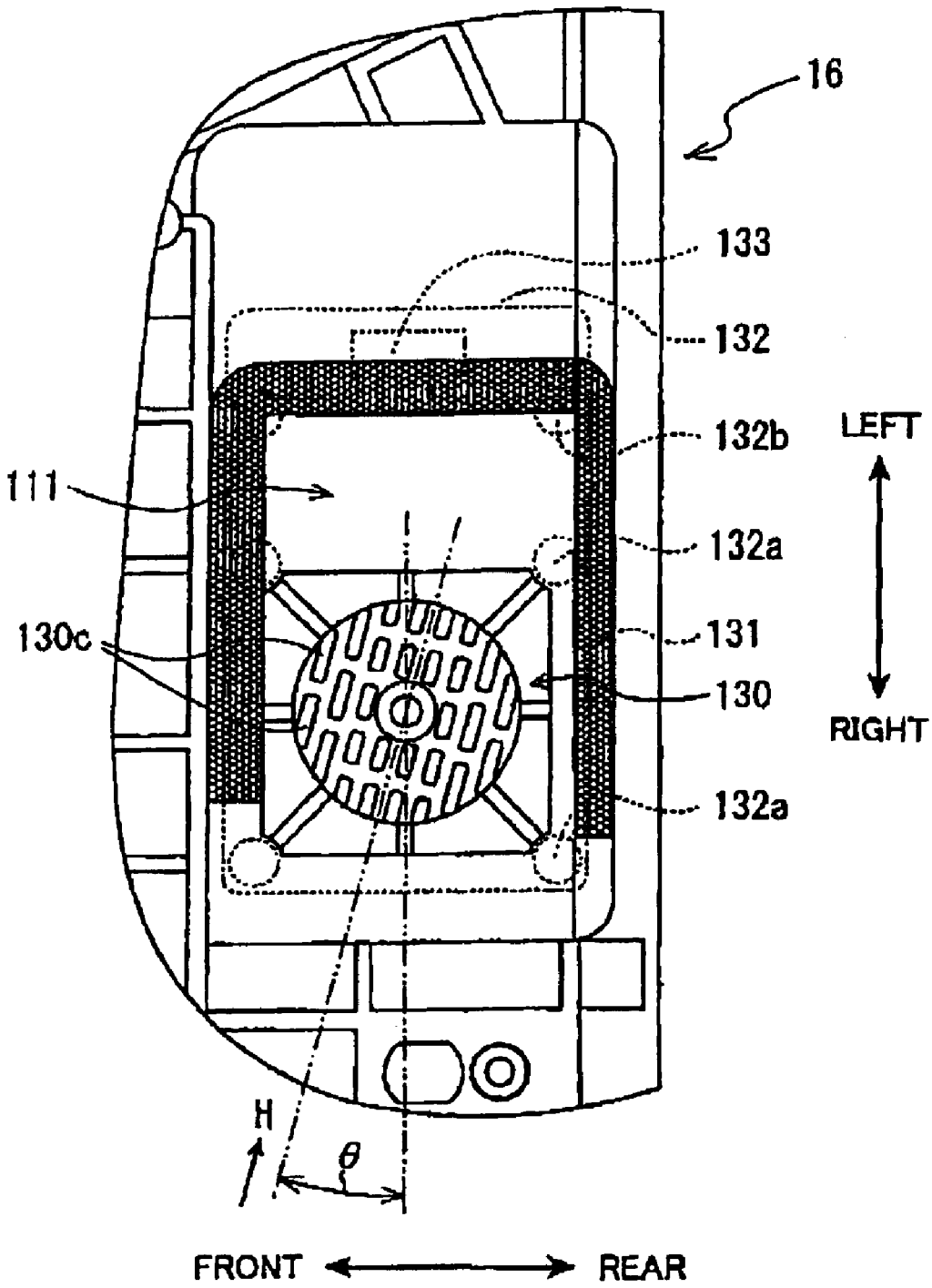
FIG. 22 is a bottom view of the scanner section fixed to the scanner unit.

The scanner section 135 is fixed to a rear end part of the main body of the scanner unit 16 by six screws 136*a* and 136*b*. Note that, right in both FIGS. 21 and 22 is the rear end direction of the scanner unit 16 as viewed from above. When the scanner section 135 is fixed to the scanner unit 16, the scanner section 135 is attached onto a frame of the scanner unit 16 from above, with the surface of the substrate 132 on which the heat sink 130 is mounted facing downward. At this time, the base 130*b* of the heat sink 130 engages in a positioning hole opened in the frame, so that the orientation of the polygon mirror 19 in the scanner unit 16 is fixed. Then, the scanner section 135 is fixed onto the frame of the scanner unit 16 by the screws 136*a* and 136*b*, so that the polygon mirror 19 on the substrate 132 is supported at four points on the frame by the screws 136*a* located symmetrically around a rotational axis of the polygon mirror 19. Since the polygon mirror 19 is supported on the frame in this way, a balance of a supporting force supporting the rotational central axis of the polygon mirror 19 is improved, and vibration of the polygon mirror 19 rotated at an extremely high speed can be suppressed. Note that a signal line for transmitting a control signal for the rotation of the motor 19*c* of the polygon mirror 19 is connected to the connector 133.

As shown in FIG. 22, a bottom surface of the scanner unit 16 is opened in substantially a square shape in the part where the scanner unit 135 is fixed, and the heat sink 130 is exposed to the outside of the scanner unit 16 from the part. Note that, because the flange section 130*a* is located above the frame of the scanner unit 16, it is not exposed from the opening part. The sponge 131 is fixed to the bottom surface of the scanner unit 16 so as to partially encompass the heat sink 130. That is, the sponge 131 forms walls on a front side (front surface side of the main body case 2 which is a left direction in FIG. 22), a rear side (back surface side of the main body case 2 which is a right direction in FIG. 22), and a left side (left side of the main body case 2 which is an upward direction in FIG. 22) of the heat sink 130. However, no wall is formed by the sponge 131 at the right side (right side of the main body case 2 which is a downward direction in FIG. 22) of the heat sink 130 in a fixing direction of the heat sink 130, so that the heat sink 130 is exposed in a direction of the bottom surface of the main body case 2.

As shown in FIG. 22, the sponge 131 is provided protrudingly from the bottom surface of the scanner unit 16 and adapted to abut against the lower portion 61 of the scanner unit 16 in order to seal a gap between the bottom surface of the scanner unit 16 and the lower portion 61 of the scanner unit 16. The portion of the lower portion 61 that includes the opening part 109 and that is to the inside of the sponge 131 defines an exhaust chamber 111. The heat radiation fins 130*c* of the heat sink 130 are exposed in the exhaust chamber 111, and the heat radiation fins 130*c* are arranged at a position between an opened part of the sponge 131 and the opening part 109.

The heat radiation fins 130*c* are aligned in an angle θ as described above. Although not shown, reinforcement ribs are provided on some portions at the floor surface of the scanner unit 16. However, no ribs are provided at the section to the left side and slightly to the front of the heat sink 130, so that air flows in the direction of the heat sink 130 passing through the section. The angle θ is determined in the following manner. First, a flow path direction indicated by arrow H in FIG. 22 is analyzed by, for example, simulation with a computer. The flow path direction is the direction in which air flows across the section of the scanner unit 16 with not ribs, through the opened part of the sponge 131, in between the bottom surface of the scanner unit 16 and the lower portion 61 of the scanner unit 16, into the exhaust chamber 111, passed the heat sink 130, and out through the opening part 109. The angle θ is then calculated between the flow path direction and the width direction of the scanner unit 16. By aligning the heat radiation fins 130*c* in the surface directions thereof in the flow path direction, because the flow of the air passing through the heat sink 130 is not interrupted and an air resistance of the flow can be controlled to a minimum, the heat radiation fins 130*c* can radiate heat emitted from the polygon mirror 19 into the air efficiently.

Next, structures of the duct wall 100 and the fans 108*a*, 117, and 118 will be described in more detail with reference to FIGS. 9 to 11.

The openings 106 are formed in the connecting wall section 1001 and the fixing-unit-side wall section 1002. The openings 106 are opened from a lower middle position on the connecting wall section 1001 to the fixing-unit-side wall section 1002 and bring the heat duct 100*b* into fluid communication with the exhaust chamber 102. The openings 106 are provided at a position closer to the right side of the main body case 2 in the width direction of the heat duct 100*b*.

In addition, the fan 117 for exhausting heat is provided nearer the left side of the main body case 2. As can be seen in FIG. 10, the lower half of the fan 117 is exposed in the exhaust chamber 102 from a rotation shaft of fins thereof and exhausts air from the exhaust chamber 102 directly out from the main body case 2. On the other hand, the upper half of the fan 117 is in fluid communication with the left end of the heat duct 100*b* through a connection hole 119 (shown in FIG. 8) and a connection duct 112. The fan 117 draws air from the heat duct 100*b*, through the connection duct 112, to the outside of the main body case 2.

The fan 118 is provided to the rear and above the fan 117 in the main body case 2. The fan 118 is located adjacent to the side of the fixing device 18 and exhausts heat mainly generated by the fixing device 18. However, no exhaust chamber is provided specifically for the fan 118, so the fan 118 also exhausts air in a general manner from the entire main body case 2.

Next, operation of the laser printer 1 at the time of printing will be described with reference to FIGS. 1 and 2. The sheet 3 located at the top among the sheets stacked on the sheet pressing plate 7 of the sheet feed tray 6 is pressed toward the sheet feed roller 8 by a not-shown spring from the back of the sheet pressing plate 7. When printing is started, the sheet 3 is fed by a frictional force between the sheet 3 and the rotating sheet feed roller 8 and, first, is nipped between the sheet feed roller 8 and the separation pad 9. At this point, a plurality of sheets 3 may be doubly fed due to influence of a frictional force among the sheets. Thus, in order to prevent the plurality of sheets from being conveyed as doubly fed, the separation pad 9 is provided. A leading edge surface of the doubly fed sheets 3 in the conveying direction is subjected to a resistance due to a frictional force between the leading edge surface and the separation pad 9 and the doubly fed sheets 3 are separated into single sheets. The sheets 3 separated into the single sheets have paper powder adhered to surfaces thereof removed when the single sheets passes paper powder removing rollers 10 and are conveyed to the registration roller 12 by the conveying rollers 11 opposed to the paper powder removing rollers 10.

On the other hand, in the scanner unit 16, a laser beam, which is generated by a laser beam emitting section (not shown) based upon a laser drive signal generated by an engine controller (not shown), is emitted to the polygon mirror 19. The polygon mirror 19 scans the surface of the sheet with the incident laser beam in a main scanning direction (direction perpendicular to the conveying direction of the sheet 3) and emits the laser beam to the fθ lens 20. The fθ lens 20 converts the laser beam used in scanning at a constant angular speed into a laser beam for constant speed scanning. Then, the laser beam has an advance direction thereof changed by the reflecting mirror 21 and is converged by the release lens 22 focused on the surface of the photosensitive drum 27.

The photosensitive drum 27 is charged to, for example, approximately 1000 V in a surface potential thereof by the Scorotron charger 29. Next, the photosensitive drum 27 rotating in a direction of arrow (counterclockwise direction in FIG. 1) is subjected to irradiation of a laser beam. The laser beam is emitted on a main scanning line of the sheet 3 such that it is irradiated on a part to be developed and not irradiated on a part not to be developed. In the part subjected to irradiation of the laser beam (bright part), a surface potential thereof decreases to, for example, approximately 100V. Then, the laser beam is also irradiated in a sub-scanning direction (conveying direction of the sheet 3) according to the rotation of the photosensitive drum 27, and an electrical invisible image, that is, an electrostatic latent image is formed on the surface of the photosensitive drum 27 according to a part on which the laser beam is not irradiated (dark part) and the bright part.

The toner in the toner box 34 is supplied to the developing roller 31 according to the rotation of the supply roller 33. At this point, the toner is frictionally charged positively between the supply roller 33 and the developing roller 31 and is further adjusted so as to become a thick layer of a fixed thickness and carried on the developing roller 31. A positive bias of, for example, approximately 300 to 400 V is applied to the developing roller 31. The toner, which is carried on the developing roller 31 and charged positively, transfers to the electrostatic latent image formed on the surface of the photosensitive drum 27 when the toner comes into contact with the photosensitive is drum 27 in an opposed state. That is, because a potential of the developing roller 31 is lower than the potential of the dark part (+1000 V) and higher than the potential of the bright part, the toner transfers selectively to the bright part where the potential is low. In this way, a visible image of toner is formed on the surface of the photosensitive drum 27 and development is performed.

The registration roller 12 registers the sheet 3 and delivers the sheet 3 at timing when a top end of the visible image formed on the surface of the rotating photosensitive drum 27 and a leading edge of the sheet 3 coincide with each other. Then, when the sheet 3 passes between the photosensitive drum 27 and the transfer roller 30, the toner electrostatically adhered to the surface of the photosensitive drum 27 is about to transfer to the transfer roller 30 to which a negative bias of, for example, approximately −200 V which is lower than the potential of the bright part (+100 V) is applied. However, the toner is blocked by the sheet 3 and cannot transfer to the transfer roller 30. As a result, the toner is transferred onto the sheet 3. That is, the visible image formed on the surface of the photosensitive drum 27 is transferred onto the sheet 3.

Then, the sheet 3 having the toner transferred thereon is conveyed to the fixing device 18. Residual charges of the toner and the sheet 3 are removed by the grounded charge removing plate 107 when the sheet 3 passes there. Then, the fixing device 18 applies heat of approximately 200 degrees with the heating roller 41 and applies a pressure with the pressing roller 42 onto the sheets 3 having the toner thereon to deposit the toner on the sheet 3 and form a permanent image. Note that the heating roller 41 and the pressing roller 42 are grounded via diodes, respectively, and are constituted such that a surface potential of the pressing roller 42 is lower than a surface potential of the heating roller 41. Thus, because the positively charged toner placed on the heating roller 41 side of the sheet 3 is electrically attracted by the pressing roller 42 with the sheet 3 therebetween, irregularity of an image due to attraction of the toner to the heating roller 41 at the time of fixing is prevented.

The sheet 3 having the toner pressurized, heated and fixed thereon is conveyed on the sheet delivery path 44 by the sheet delivery roller 45 and is delivered to the sheet discharge tray 46 with a print surface thereof facing downward. Similarly, the sheet 3 to be printed next is stacked over the earlier delivered sheet 3 with a print surface thereof facing downward in the discharge tray 46. In this way, a user can obtain the sheets 3 arranged in the order they were printed.

Figure 16:
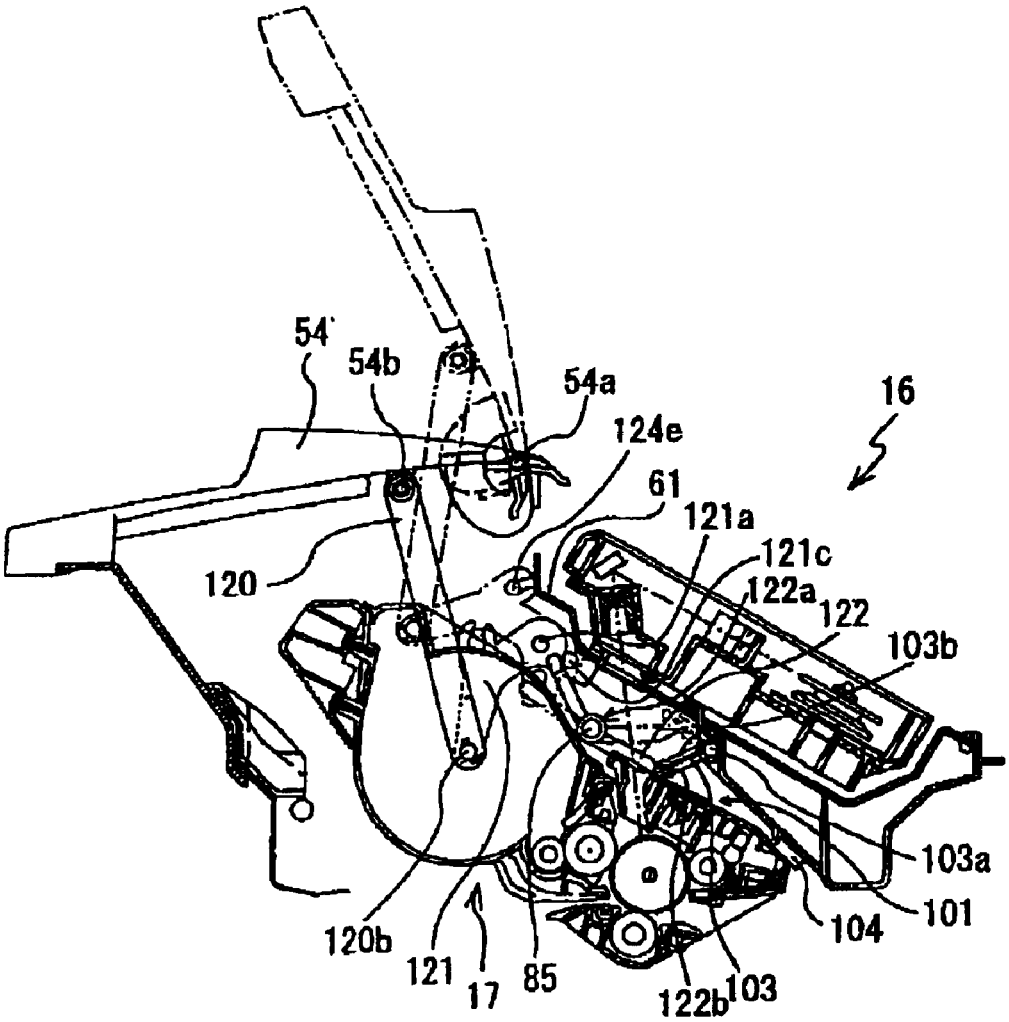
FIG. 16 is a side view showing ganged movement of the cover and the shutter by the link mechanism.

Next, an operation of the link mechanism will be described with reference to FIGS. 13, 16, and 17. Note that, in FIGS. 13, 16, and 17, positions of respective components of the link mechanism when the upper surface cover 54 is opened are indicated by solid lines and positions of the respective components of the link mechanism when the upper surface cover 54 is closed are indicated by two-dot chain line.

First, a state in which the shutter 103 is opened and closed in accordance with opening and closing operations of the upper surface cover 54 will be described with reference to FIG. 16. As shown in FIG. 16, when the upper surface cover 54 is closed, the shaft 54*b* is located on the front side (left direction in FIG. 16) of the main body case 2 substantially horizontal with respect to the shaft 54*a*. The end of the cam plate 121 connected to the first link 120 is at a lower position. That is, when the upper surface cover 54 moves from an opened to closed position, the first link 120 presses the end of the cam plate 121 downward into the main body case 2, so that the cam plate 121 pivots counterclockwise around the bearing 121*a* until the cover is closed. At this point, the pin 121*c* of the cam plate 121 stops in a position proximate to the lower portion 61 of the cartridge receiving section 57.

Because the pin 121*c* is positioned near the lower portion 61, the pin 121*c* no longer presses the second link 122 to pivot counterclockwise. Therefore, the hook portion 103*b* of the shutter 103 loses the upward support force from the second link 103*b*. As a result, the free end of the shutter 103 pivots vertically downward under the force of gravity, with the shaft 103*a* as a fulcrum, into its closed position. While in the closed position, the free end of the shutter 103 contacts the upper surface of the process cartridge 17 at a position between the opening part of the Scorotron charger 29 and the exposure window 69. On the other hand, the protrude and contact portion 122*b* of the second link 122 is subjected to a downward gravity force from the hook portion 103*b* of the shutter 103. Because the protrude and contact portion 122*b* is pressed downward, the second link 122 rotates clockwise. In addition, because the pin 121*c* of the cam plate 121 is in an upper most position of a movable range thereof and does not prevent the rotation of the second link 122, the shutter 103 is closed.

When the upper surface cover 54 is opened (as indicated by two-dot chain line in FIG. 16), the shaft 54*b* is moved to a position higher than that when the upper surface cover 54 is closed. Then, the first link 120 coupled to the shaft 54*b* is raised to apply a rotation force in the clockwise direction to the cam plate 121. The cam plate 121 rotates with the bearing 121*a* part as a fulcrum and, as a result, the pin 121*c* is moved downward. The pin 121*c* pushes the contact part 122*c* of the second link 122 downward, and the second link 122 rotates in the counterclockwise direction with the bearing 122*a* part as a fulcrum. Then, because the protrude and contact portion 122*b* moves upward and presses the hook portion 103*b* of the shutter 103 from a bottom thereof, the protrude and contact portion 122*b* pushes up the shutter 103 to an opened position thereof against a downward pressure due to the own weight of the shutter 103.

Next, a state in which the driving force output section 115 is advanced and retracted in accordance with the opening and closing operations of the upper surface cover 54 will be described with reference to FIGS. 13 and 17. Note that an operation of the first link 120 and a rotation of the cam plate 121 in association with the upper surface cover 54 when the upper surface cover 54 is opened or closed are the same as the above-mentioned case.

Figure 17:
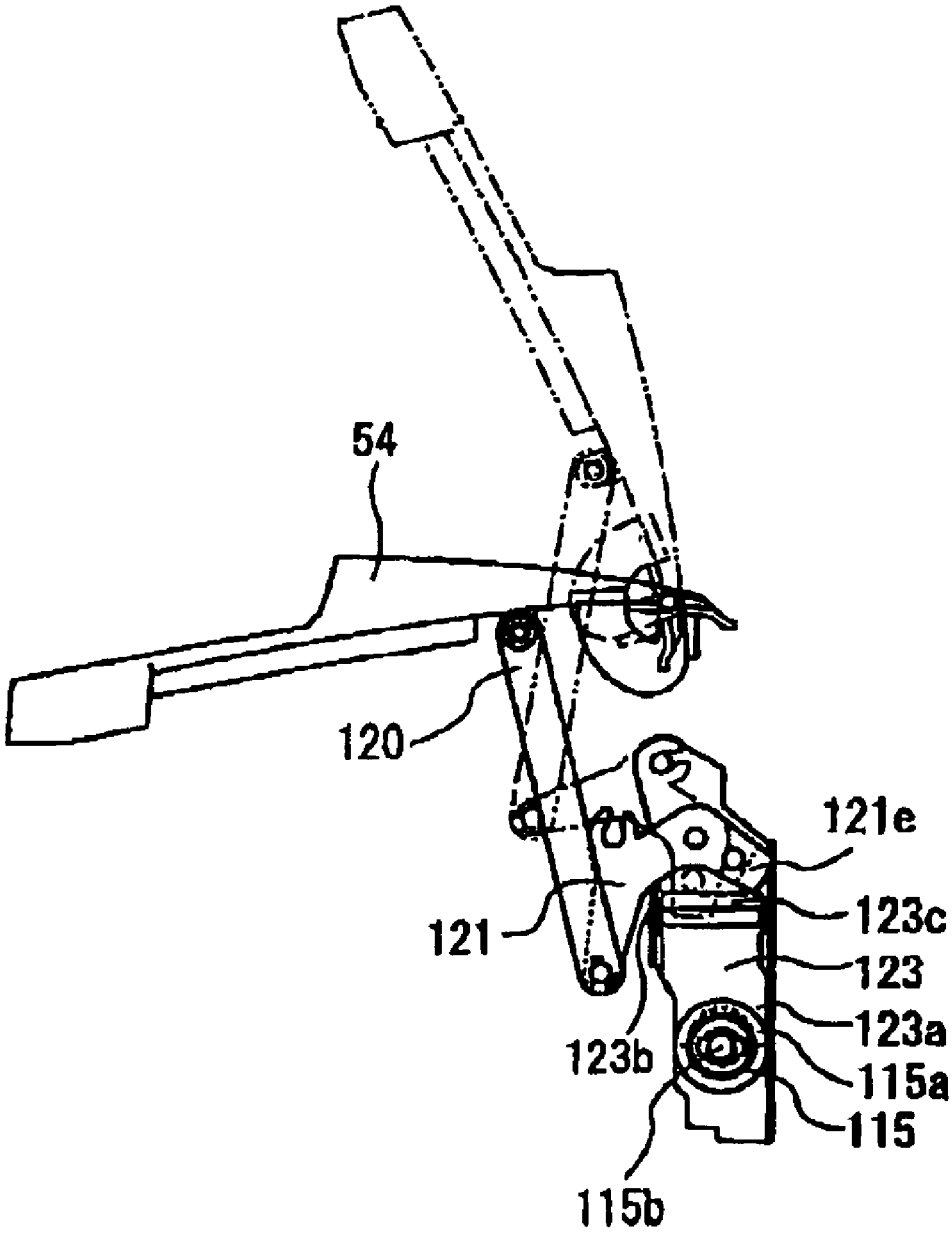
FIG. 17 is a side view showing ganged movement of the cover and the shutter by the link mechanism.

As shown in FIG. 17, the slope 121*e* of the cam plate 121 is rotated into a non-contact position with the advance and retract plate 123 when the upper surface cover 54 is closed, and the advance and retract plate 123 is not subjected to a pressing force from the cam plate 121. At this point, as shown in the side view of FIG. 13, the driving force output section 115 is biased by the spring 116 and the tip end 115*b* thereof engages with an engagement part of the driving force input section 110 provided on the side of the process cartridge 17.

In addition, when the upper surface cover 54 is opened, the slope 121*e* of the cam plate 121 comes into contact with the protrude and contact portion 123*c* of the advance and retract plate 123. The slope 121*e* gradually presses the protrude and contact portion 123*c* in accordance with the rotation of the cam plate 121. Then, the advance and retract plate 123 is rotated in a direction in which the engaging portion 123*a* side separates from the receiving section right side surface 57*b* of the cartridge receiving section 57 with the bearing 123*b* part as a fulcrum. The engaging portion 123*a* presses the flange 115*a* of the driving force output section 115 against the biasing force of the spring 116, which biases the flange 115*a* from the opposite side, and separates the tip end 115*h* thereof from the bearing portion 110*a* of the driving force input section 110 of the process cartridge 17.

As described above, when the upper surface cover 54 is opened, the link mechanism moves in association with the opening to push up the shutter 103 to the opened position, whereby the process cartridge 17 is released from the contact with the shutter 103 and, at the same time, the driving force input section 110 is separated from the driving force output section 115. Thus, attachment and detachment operations of the process cartridge 17 can be performed smoothly. In addition, when the upper surface cover 54 is closed, the shutter 103 is released from a supporting force for pushing up the shutter 103 to the opened position by the interlocking of the link mechanism and seals the exhaust chamber 101 with its own weight. Simultaneously, the driving force output section 115 is released from a pressing force for pressing it to the retract position and engages with the driving force input section 110 with the biasing force of the spring 116. Then, air in the exhaust chamber 101 filled with ozone generated by the Scorotron charger 129 at the time of printing is sucked by the fan 108*b* and discharged to the outside of the main body case 2. In the case, by causing the air to pass through the ozone filter 108*a*, ozone which is harmful to the human body can be removed.

Next, a flow path of air exhausted as guided by the duct wall 100 will be described with reference to FIGS. 2 and 9 to 12.

As shown in FIG. 9, air in the exhaust chamber 102 has a different exhaust flow path depending upon a position of the air in the width direction of the duct wall 100. The exhaust chamber 102 exhausts air containing heat mainly generated by a halogen lamp (not shown) of the fixing device 18 to the outside of the main body case 2. An air in the left side (right side in FIG. 9) of the exhaust chamber 102 in the width direction of the duct wall 100 takes a flow path indicated by arrow D, that is, the fan 117 draws air from below the duct wall 100 and discharges the air directly to the outside of the main body case 2. Air in the right side (left side in FIG. 9) of the exhaust chamber 102 in the width direction of the duct wall 100 takes a flow path indicated by arrow E, that is, the fan 117 draws the air through the openings 106, the heat duct 100*b*, and the connection duct 112, and is exhausts the air to the outside of the main body case 2. In this way, the air in the part of the exhaust chamber 102 close to the fan 117 is exhausted to the outside of the main body case 2 directly by the fan 117 and the air in the part of the exhaust chamber 102 far from the fan 117 is exhausted to the outside of the main body case 2 by the fan 117 via the heat duct 100*b*, whereby it becomes possible to compensate for insufficiency of suction of the fan 117 and exhaust the air in the exhaust chamber 102 efficiently.

As shown in FIG. 10, because the openings 106 is provided on the wall surface in the lower part of the heat duct 100*b* closer to the fixing device 18 with respect to the process cartridge 17, the hot air from the fixing device 18 is sucked into the heat duct 100*b* before it can move around the lower part of the duct wall 100 and reach the process cartridge 17. The is because, as indicated by arrow F in FIG. 2, because the air in the vicinity of the process cartridge 17 in the exhaust chamber 102 defines the flow path through which the air is sucked by the heat duct 100*b* through the openings 106, the hot air from the fixing device 18 is sucked into the duct 10 from the openings 106 without flowing against the flow of the flow path of arrow F.

Air containing ozone, which is generated when the Scorotron charger 29 charges the photosensitive drum 27, flows from the process cartridge 17 to the exhaust chamber 101 and fills the exhaust chamber 101. The air is sucked into the ozone duct 100*a* from the opening part 105. As indicated by arrow G in FIG. 11, the air flows into the exhaust pipe 108 through the connection hole 100*e* on the lower portion 61 of the duct 10. The air removes the ozone when the air passes through the ozone filter 108*a* and is discharged to the outside of the main body case 2 by the fan 108*b*.

As indicated by arrow H in FIG. 12, air flows from the part of the scanner unit 16 where no ribs are provided into the space between the scanner unit 16 and the lower portion 61 of the scanner unit 16, then flows into the exhaust chamber 111 from the opened part of the sponge 131 for surrounding the exhaust chamber 111, and passes between the heat radiation fins 130*c* of the heat sink 130 to flow out to the duct wall 100 from the opening part 109. Because the opening part 109 communicates with the ducts 100*a* and 100*b* astride the partition wall 100*d* as shown in FIG. 2, a part of the air in the exhaust chamber 111 is sucked into the ozone duct 100*a* and the remainder of the air is sucked into the heat duct 100*b*, whereby the air is discharged to the outside of the main body case 2.

As described above, of the air in the exhaust chamber 102 containing the heat mainly generated by the fixing device 18, the air in the part close to the fan 117 in the width direction of the duct wall 100 can be directly discharged to the outside of the main body case 2 by the fan 117. Then, the air in the part apart from the fan 117 flows into the heat duct 100*b* from the openings 106, passes inside the heat duct 100*b*, and can be discharged to the outside of the main body case 2 by the fan 117. In addition, because the flow path through which the air in the vicinity of the process cartridge 17 in the exhaust chamber 102 flows into the heat duct 100*b* from the openings 106 is formed, the hot air from the fixing device 18 never flows around to the process cartridge 17 side passing under the duct wall 100 against the flow path.

On the other hand, the air containing the ozone generated by the Scorotron charger 29 of the process cartridge 17 fills the exhaust chamber 101. The opening part 105 communicating with the ozone duct 100*a* is opened in the exhaust chamber 101, and the air in the exhaust chamber 101 flows into the ozone duct 100*a*. Then, the air can be discharged to the outside of the main body case 2 by the fan 108*b* included in the exhaust pipe 108 connected to the ozone duct 100*a*. In the case, because the air passes through the ozone filter 108*a*, ozone which is harmful to the human body can be removed from the air to be discharged.

Moreover, heat generated by the polygon mirror 19 of the scanner unit 16 can be radiated into the air in the exhaust chamber 111 by the heat sink 130, and the air can be dispersed to the ducts 100*a* and 100*b* and discharged to the outside of the main body case 2. In addition, because the heat radiation fins 130*c* of the heat sink 130 are aligned in surface directions thereof along the flow path of the air passing inside the exhaust chamber 111, a resistance of the air passing inside the exhaust chamber 111 can be controlled to be minimum, and exhaust can be performed efficiently.

Then, the air in the entire main body case 2 can be discharged to the outside of the main body case 2 by the fan 118, which assists exhaust of the fans 108*b* and 117 to control temperature rising in the laser printer 1.

As described above, the wall surface that defines the duct provided between the fixing unit and the process cartridge 17 inserted on the side of the fixing device 18 has the part opposed to the inserted process cartridge 17, the part opposed to the fixing device 18, and the connection part connecting both the opposed parts. An air can be exhausted from the openings 106, which communicates with the exhaust passage of the duct, opened from the middle position of the connection part to the part opposed to the fixing device 18. Therefore, air containing heat generated by the fixing device 18 can be exhausted such that the hot air does not affect the process cartridge 17.

Air in an exhaust chamber defined by the area surrounded by the inserted process cartridge 17, the fixing device 18, and the duct wall 100 can be discharged to the outside of the main body case 2 from the duct via the openings 106. Therefore, by partitioning the space in the main body case 2 as exhaust chambers, the hot air from the fixing device 18 can be exhausted efficiently.

Air in the duct can be discharged to the outside of the main body case 2 from the fan 117 provided at one end of the exhaust passage of the duct. Therefore, by generating the negative pressure in the inside of the duct, air in the exhaust chamber can be guided in the direction of the duct, and the hot air from the fixing device 18 can be discharged efficiently.

The exhaust chamber can be partitioned by the partitioning part which is provided in the vicinity of the boundary on the duct wall 100 between the part opposed to the inserted process cartridge 17 and the connection part so as to abut against the process cartridge 17. Therefore, because the capacity of the exhaust chamber can be reduced and air tightness of the exhaust chamber can be increased, the hot air from the fixing device 18 can be exhausted efficiently.

The exhaust passage for discharging air can be divided into two by the partition wall 100*d* provided inside the duct. Therefore, the capacity of the duct can be reduced, the suction force of the fan can be increased, and the hot air from the fixing device 18 can be exhausted efficiently.

In addition, heat generated by the fixing device 18 can be discharged to the outside of the main body case 2 from the heat duct 100*b* via the openings 106 together with the air, and ozone generated by the Scorotron charger can be discharged to the outside of the main body case 2 from the ozone duct 100*a* via the opening 105 together with the air. Therefore, the hot air from the fixing device 18 and the air containing ozone generated by the charger can be exhausted separately from each other.

In addition, heat generated by the fixing device 18 is discharged to the outside of the main body case 2 from the exhaust chamber 102 via the openings 106 and the heat duct 100*b* together with the air, and ozone generated by the Scorotron charger can be discharged to the outside of the main body case 2 from the exhaust chamber 101 via the opening 105 and the ozone duct 100*a* together with the air. Therefore, by partitioning the space inside the main body case 2 as an exhaust chamber, the hot air from the fixing device 18 and the air containing ozone generated by the charger can be exhausted separately from each other efficiently.

The fan 117 can discharge air in the heat duct 100*b* and the fan 108*b* can discharge air in the ozone duct 100*a* to the outside of the main body case 2. Therefore, by generating the negative pressure in the inside of the heat duct 100*b* and the ozone duct 100*a*, respectively, airs in the respective exhaust chambers can be guided to directions of the respective exhaust passages, and the hot air from the fixing device 18 and the air containing ozone generated by the charger can be exhausted separately from each other efficiently.

Air can be discharged from the opening 109 which is opened in the part opposed to the scanner unit 16 on the duct wall 100 and communicates with the exhaust passage of the duct. Therefore, the hot air from the scanner unit 16 can be exhausted by commonly using the duct.

In addition, heat radiated from the heat sink 130 can be discharged to the outside of the main body case 2 from the duct via the opening 109 together with air flowing in is from the opened part of the sponge 131. Therefore, an exhaust flow path passing through the heat sink 130 can be formed, whereby the hot air from the scanner unit 16 can be exhausted efficiently.

Air can be exhausted from the opening 109 which is opened in the position astride the partition wall 100*d* on the duct wall 100 in the part opposed to the scanner unit 16 so as to communicate with the heat duct 100*b* and the ozone duct 100*a*, respectively. Therefore, because heat emitted from the heat sink 130 can be exhausted utilizing the two exhaust passage, the hot air from the scanner unit 16 can be exhausted efficiently.

The part of the heat radiated from the heat sink 130 can be discharged to the outside of the main body case 2 from the heat duct 100*b* via the opening 109 together with air flowing in from the opened part of the sponge 131, and the part of the heat radiated from the heat sink 130 can be discharged to the outside of the main body case 2 from the ozone duct 100*a* via the opening 109 together with the air flowing in from the opened part of the sponge 131. Therefore, there can be formed exhaust flow paths passing through the heat sink 130 and flowing out to the two exhaust passages respectively, whereby the hot air from the scanner unit 16 can be exhausted efficiently.

The heat radiated from the heat sink 130 can be discharged to the outside of the main body case 2 from the duct via the opening 109 through the exhaust chamber 111 together with the air. Therefore, by partitioning the space inside the main body case 2 as an exhaust chamber, the hot air from the scanner unit 16 can be exhausted efficiently.

The scanner unit 16 can radiate its heat with the heat sink having the fins provided so as to lie along, in the plane direction thereof, the flow path of air which flows in the opened part of the sponge 131 and flows out to the duct from the opening 109. Therefore, because the flow path of the air passing through the heat sink is not prevented by the fins, the hot air from the scanner unit 16 can be exhausted efficiently.

In addition, of air in an area surrounded by the wall surface, which extends from the connection part of the duct wall 100 to the part opposed to the fixing device 18, and the respective opposed parts of the inserted process cartridge 17 and the fixing device 18, the air on the side of one side on the main body case 2 can be directly discharged to the outside of the main body case 2 from the fan 117, and the air on the side of the other side of the main body case 2 can be discharged to the outside of the main body case 2 from the fan 117 via the openings 106 and the duct. Therefore, the air in the part apart from the fan 117 can be sucked via the duct and insufficiency of suction force with respect to the part can be compensated, whereby the hot air from the fixing device 18 can be exhausted efficiently.

The fan 118 can discharge heat generated in the main body case 2 to the outside of the main body case 2 independently of the fan 117 and the fan 108*b*. Therefore, air containing heat in the part which cannot be exhausted by the fan 117 and the fan 108*b* can be exhausted by the fan 118.

As described above, the shutter 103, which is provided so as to be able to move between the contact position where the shutter 103 is in contact with an outer portion of the housing of the process cartridge 17 and the disengage position where the shutter 103 disengages from the contact position, can constitute the exhaust chamber which connects the opening of the housing of the process cartridge 17 and the opening of the receiving section opened in the exhaust passage for communicating the receiving section and the outside of the main body case 2. Therefore, air in the vicinity of the charger can be exhausted from the opening of the housing of the process cartridge 17 to the outside of the main body case 2 via the exhaust chamber and through the exhaust passage.

The ozone generated by the charger is exhausted to the outside of the main body case 2 via the exhaust chamber and the exhaust passage. Therefore, deterioration of the photosensitive drum 27 due to the ozone can be prevented.

The ozone generated by the charger can be exhausted to the outside of the main body case 2 by the exhaust fan provided in the exhaust passage. Therefore, the ozone can be exhausted efficiently.

The removing means provided in the exhaust passage can remove ozone. Therefore, ozone can be removed from air to be exhausted to the outside of the main body case 2.

The supporting portions of the shutter 103 can support the shutter 103 such that the free end of the shutter 103 can pivot with one end of the shutter 103 as the fulcrum. Therefore, the structure of the shutter 103 can be simplified.

The supporting portion can be provided on the upstream side of the opening of the receiving section in the inserting direction of the process cartridge 17. Therefore, the capacity of the exhaust chamber can be reduced to increase an exhaust efficiency.

The interlocking mechanism can move the shutter 103 in association with opening and closing of the case cover for closing the receiving section. Therefore, movement of the shutter 103 can be performed easily.

The shutter 103 moved in association with the case cover can come into contact with the housing due to its own weight when the case cover is closed. Therefore, the structure for opening and closing the shutter 103 can be simplified.

The interlocking mechanism can cause the driving force output section to engage with the driving force input section when the case cover is closed and to disengage from the driving force input section when the case cover is opened. Therefore, engagement and disengagement of the driving force input section and the driving force output section can be easily conducted.

An inner side of insertion of the process cartridge 17 of the receiving section is in contact with the more inner side of insertion than the opening of the housing of the process cartridge 17, and on the other hand, the shutter 103 is provided on the inserting side of the process cartridge 17 of the receiving section so as to be movable between the contact position where the shutter 103 is in contact with the part closer to the inserting side than the opening of the housing of the process cartridge 17 and the disengage position where the shutter 103 disengages from the contact position, so that an exhaust chamber can be structured to connect the opening of the receiving section and the opening of the housing of the process cartridge 17 when the process cartridge 17 is received. Therefore, the air in the vicinity of the charger can be exhausted from the opening of the housing of the process cartridge 17 to the outside of the main body case 2 via the exhaust chamber and passing through the exhaust passage.

The resilient partitioning member 104 can be provided in the contact part with the, housing of the process cartridge 17 of the receiving section. Therefore, air tightness and exhaust efficiency of the exhaust chamber can be increased.

The charger of the process cartridge 17 can be extended along an axial direction of the photosensitive drum 27. Therefore, the charger can charge the photosensitive drum 27 along the axial direction of the photosensitive drum 27.

The process cartridge 17 can be attached to and detached from the receiving section of the main body case 2 along the direction perpendicular to the axial direction of the photosensitive drum 27. Therefore, the process cartridge 17 can be inserted into an inner direction of the main body case 2 that is vertical to the axial direction of the photosensitive drum 27.

The supporting portions can support the shutter 103 such that the free end of the shutter 103 becomes pivotable with one end in the direction perpendicular to the extending direction of the shutter 103 as the fulcrum. Therefore, the structure of the shutter 103 can be simplified.

While some exemplary embodiments of the invention have been described in detail, those skilled in the art will recognize that there are many possible modifications and variations which may be made in these exemplary embodiments while yet retaining many of the novel features and advantages of the invention.

For example, although the openings 106 of the duct wall 100 consist of four separate openings, a mesh-like opening part or an opening part having a large number of slits can be used instead. The heat duct 100*b* may be further projected into the exhaust chamber 102 to form the exhaust chamber 102 in a smaller size. Although the exhaust chamber 111 communicates with each of the ducts 100*a* and 100*b*, it may communicate with only one of them. Alternatively, a third duct may be provided that communicates with the exhaust chamber 111.

Although the shutter 103 closes the exhaust chamber 101 with its own weight, the exhaust chamber 101 may be closed utilizing the biasing force of spring. The supporting portions 100*c* of the duct 101*a* for supporting the shutter 103 may be disposed such that the shaft side of the shutter 103 is on the upstream side of the free end side thereof in the inserting direction of the process cartridge 17 when the shutter 103 is supported. Although the exhaust chamber 101 is provided in order to discharge ozone mainly generated by the charger, it may be utilized for the purpose of discharging air containing heat generated by the charger. Although the exhaust chamber 101 includes the upper surface part of the process cartridge 17, the wall surface in the lower part of the duct wall 100, and the partitioning member 104 and is constituted such that opening and closing of the opened part of the exhaust chamber is performed by the shutter 103 in the embodiment, an exhaust chamber may include the shutter which movably opens and closes so as to cover the upper surface part of the process cartridge 17.

What is claimed is:

1. An image forming device for forming developer images on a recording medium, the image forming device comprising:

a main body case;

an image bearing member disposed within the main body case and having a surface;

a latent image forming unit disposed within the main body case, the latent image forming unit forming an electrostatic latent image on the surface of the image bearing member;

a process cartridge that is removably disposed in the main body case;

a developing unit disposed within the process cartridge, the developing unit holding developer and using the developer to form a developer image on the image bearing member;

a transfer unit disposed within the main body case at a position in opposition with the process cartridge, the transfer unit transferring the developer image on the image bearing member onto the recording medium;

a fixing unit disposed within the main body case, the fixing unit generating heat to thermally fix the developer image onto the recording medium;

a duct wall having a cartridge-side wall section opposed to the process cartridge, a fixing-unit-side wall section opposed to the fixing unit, and a connecting wall section that connects the cartridge-side wall section and the fixing-unit-side wall section together, the cartridge-side wall section, the fixing-unit-side wall section, and the connecting wall section defining a duct that extends between the fixing unit and the process cartridge, the connecting wall section and the fixing-unit-side wall section being formed with a fixing-unit-side through hole that extends from a portion of the connecting wall section to a portion of the fixing-unit-side wall section; and an exhaust unit that draws air in the vicinity of the fixing unit, through the through hole and the duct, to outside the main body case.

2. The image forming device as claimed in claim 1, wherein the process cartridge, the fixing unit, and the duct wall define an exhaust chamber that is in fluid communication with the duct through the fixing-unit-side through hole, the exhaust unit drawing air from the exhaust chamber through the through hole and the duct to outside the main body case.

3. The image forming device as claimed in claim 2, wherein the fixing unit and the process cartridge are separated from each other in a separation direction, the duct wall extending in a traverse direction traverse to the separation direction, the duct having two opposite ends with respect to the traverse direction, the exhaust unit including a fixing-unit-side passage fan in fluid communication with one end of the duct, the fixing-unit-side through hole being formed in the connecting wall section and the fixing-unit-side wall section at a position separated from the one end of the duct with respect to the traverse direction, the fixing-unit-side passage fan drawing air from a portion of the exhaust chamber that is nearer to the fixing-unit-side through hole than to the one end of the duct through the fixing-unit-side through hole and the duct to outside the main body case and drawing air from a portion of the exhaust chamber that is nearer to the one end of the duct than to the fixing-unit-side through hole directly outside the main body case.

4. The image forming device as claimed in claim 2, further comprising an inter-cartridge/duct-wall member that extends between the process cartridge and the cartridge-side wall section of the duct wall, the inter-cartridge/duct-wall member defining the exhaust chamber with the process cartridge, the fixing unit, and the duct wall.

5. The image forming device as claimed in claim 1, wherein the fixing unit and the process cartridge are separated from each other in a separation direction, the duct wall extending in a traverse direction traverse to the separation direction, the duct having two opposite ends with respect to the traverse direction, the exhaust unit including a fixing-unit-side passage fan in fluid communication with one end of the duct.

6. The image forming device as claimed in claim 1, further comprising a partition wall that extends from the duct wall to partition the duct into two sections.

7. The image forming device as claimed in claim 6, wherein:

the partition wall and the fixing-unit-side wall section define a fixing-unit-side passage that includes the fixing-unit-side through hole, the exhaust unit drawing heat generated by the fixing unit through the fixing-unit-side passage together with air to outside of the main body case; and the process cartridge includes a charger for charging the image bearing member, the charger generating ozone while charging the image bearing member, the cartridge-side wall section being formed with a cartridge-side through hole, the partition wall and the cartridge-side wall section defining a cartridge-side passage that includes the cartridge-side through hole, the exhaust unit drawing ozone generated by the charger through the cartridge-side passage together with air to outside of the main body case.

8. The image forming device as claimed in claim 7, further comprising an inter-cartridge/duct-wall member that extends between the process cartridge and the cartridge-side wall section of the duct wall, wherein:

the fixing unit and the process cartridge each include an opposing surface, the opposing surfaces being in opposition with each other, the opposing surfaces of the fixing unit and the process cartridge, the inter-cartridge/duct-wall member, and the connecting wall section and the fixing-unit-side wall section of the duct wall defining a heat exhaust chamber, the exhaust unit exhausting heat generated by the fixing unit through the heat exhaust chamber, the fixing-unit-side through hole, and the fixing-unit-side passage together with air to outside of the main body case; and the process cartridge has a wall formed with an ozone exhaust through hole, the cartridge-side wall section, the wall formed with the ozone exhaust through hole, and the inter-cartridge/duct-wall member defining an ozone exhaust chamber that brings the ozone exhaust through hole of the process cartridge into fluid communication with the cartridge-side through hole, the exhaust unit exhausting ozone generated by the charger through the ozone exhaust chamber, the cartridge-side through hole, and the cartridge-side passage together with air to outside of the main body case.

9. The image forming device as claimed in claim 7, wherein the fixing unit and the process cartridge are separated from each other in a separation direction, the duct wall extending in a traverse direction traverse to the separation direction, the fixing-unit-side passage and the cartridge-side passage each having two opposite ends with respect to the traverse direction, the exhaust unit including a cartridge-side passage fan and a fixing-unit-side passage fan, the fixing-unit-side passage fan being in fluid communication with one end of the fixing-unit-side passage, the fixing-unit-side passage fan exhausting air through the fixing-unit-side passage to outside of the main body case, the cartridge-side passage fan being in fluid communication with one end of the cartridge-side passage, the cartridge-side passage fan exhausting air through the cartridge-side passage to outside of the main body case.

10. The image forming device as claimed in claim 9, further comprising a general fan that is provided at one side of the main body case with respect to the traverse direction, the general fan exhausting air from within the main body case to outside of the main body case independently from the fixing-unit-side passage fan and the cartridge-side passage fan.

11. The image forming device as claimed in claim 7, further comprising an exposure unit and an exposure-unit-side wall, the exposure-unit-side wall being disposed between the exposure unit and the duct wall, the exposure-unit-side wall being formed with an exposure through hole and an exposure-unit-exhaust through hole, the exposure unit exposing the image bearing member with light through the exposure through hole to form the electrostatic latent image on the image bearing member, the exposure-unit-exhaust through hole being formed astride the partition wall to bring the exposure-exhaust through hole into fluid communication with both the cartridge-side passage and the fixing-unit-side passage.

12. The image forming device as claimed in claim 11, wherein the exposure unit further includes:

a heat radiator that radiates heat, the heat radiator being in fluid communication with the exposure-exhaust through hole of the exposure-unit-side wall; and a guide wall connected to the exposure-unit-side wall and formed with an open portion, the guide wall encompassing the heat radiator and the exposure-exhaust through hole except at the open portion, the open portion and the exposure-exhaust through hole being located on substantially opposite sides of the heat radiator, the exhaust unit exhausting air from the exposure through hole, through the open part of the guide wall, past the heat radiator, through the exposure-exhaust through hole, and through both cartridge-side passage and the fixing-unit-side passage to outside of the main body case.

13. The image forming device as claimed in claim 12, wherein the guide wall and the exposure-unit-side wall define an exhaust chamber, the exhaust unit exhausting air past the heat radiator, through the exhaust chamber, and through the duct to outside of the main body case.

14. The image forming device as claimed in claim 12, wherein the exhaust unit exhausts air following a flow pathway in a direction from the open portion of the guide wall to the exposure-exhaust through hole, the heat radiator including a plurality of plate-like fins for radiating heat, the plate-like fins being aligned and extending in the direction of the flow pathway.

15. The image forming device as claimed in claim 1, further comprising an exposure unit and an exposure-unit-side wall, the exposure unit exposing the image bearing member with light to form the electrostatic latent image on the image bearing member, the exposure-unit-side wall being disposed between the exposure unit and the duct wall and being formed with an exposure-exhaust through hole that brings the exposure unit into fluid communication with the duct.

16. The image forming device as claimed in claim 15, wherein the exposure unit further includes:

a heat radiator that radiates heat, the heat radiator being in fluid communication with the exposure-exhaust through hole of the exposure-unit-side wall; and a guide wall connected to the exposure-unit-side wall and formed with an open portion, the guide wall encompassing the heat radiator and the exposure-exhaust through hole except at the open portion, the open portion and the exposure-exhaust through hole being located on substantially opposite sides of the heat radiator, the exhaust unit exhausting air from the exposure unit, through the open part of the guide wall, past the heat radiator, through the exposure-exhaust through hole, and through the duct to outside of the main body case.

17. The image forming device as claimed in claim 16, wherein the guide wall and the exposure-unit-side wall define an exhaust chamber, the exhaust unit exhausting air past the heat radiator, through the exhaust chamber, and through the duct to outside of the main body case.

18. The image forming device as claimed in claim 16, wherein the exhaust unit exhausts air following a flow pathway in a direction from the open portion of the guide wall to the exposure-exhaust through hole, the heat radiator including a plurality of plate-like fins for radiating heat, the plate-like fins being aligned and extending in the direction of the flow pathway.

19. An image forming device comprising:

a detachable process cartridge that forms images on recording medium, the process cartridge including a housing, a photosensitive member, and a charger, the housing supporting the photosensitive member and the charger in confrontation with each other and being formed with a cartridge through hole near the charger, the charger charging the photosensitive member;

a main body case formed with a receiving section that receives the process cartridge and an exhaust hole that brings the receiving section into fluid communication with outside the main body case;

a movable member that moves between a contact position and a non-contact position, the movable member, when in the contact position, contacting the cartridge housing and defining an exhaust chamber that connects the exhaust hole of the receiving section to the cartridge through hole, the movable member, when in the non-contact position, being out of contact with the cartridge housing; and an exhaust unit that draws air through the exhaust chamber and the exhaust hole together to outside of the main body case.

20. The image forming device as claimed in claim 19, wherein the charger generates ozone while charging the image bearing member, the exhaust unit drawing the ozone generated by the charger through the cartridge-side passage, through the exhaust chamber, and through the exhaust hole together with air to outside of the main body case.

21. The image forming device as claimed in claim 20, wherein the exhaust unit includes an exhaust fan in fluid communication with the exhaust hole, the exhaust fan drawing the ozone generated by the charger to outside of the main body case.

22. The image forming device as claimed in claim 20, further comprising a removing unit in fluid communication with the exhaust hole, the removing unit removing the ozone drawn through the exhaust hole by the exhaust unit.

23. The image forming device as claimed in claim 19, wherein the movable member has a plate shape with a free edge and a supported edge, the receiving section including a supporting portion that pivotably supports the supported edge of the movable member so that the movable member is pivotable between the non-contact position and the contact position.

24. The image forming device as claimed in claim 23, wherein the process cartridge is inserted into the receiving section in an insertion direction, the supporting portion being located at an upstream side of the exhaust hole of the receiving section with respect to the insertion direction.

25. The image forming device as claimed in claim 19, further comprising:

a case cover attached to the main body case and movable between an open position for opening the receiving section and a closed position for covering the receiving section; and an interlocking unit that moves the movable member into the non-contact position ganged with movement of the case cover into the open position.

26. The image forming device as claimed in claim 25, wherein the interlocking unit positively supports the movable member in the non-contact position when the case cover is in the open position and releases support of the movable member so that the movable member falls into the contact position under force of gravity when the case cover is in the closed position.

27. The image fanning device as claimed in claim 19, wherein the process cartridge is inserted into the receiving section in an insertion direction, the movable member contacting the cartridge housing at an upstream abutment position of the process cartridge when the movable member is in the contact position, the receiving section abutting the process cartridge at a downstream abutment position of the process cartridge and defining the exhaust chamber with the movable member and the process cartridge, the downstream abutment position being downstream from the upstream abutment position with respect to the insertion direction.

28. The image forming device as claimed in claim 27, wherein the receiving section including a resilient member at a position corresponding to the downstream abutment position of the process cartridge, the resilient member of the receiving section abutting the process cartridge at a downstream abutment position.

29. The image forming device as claimed in claim 19, wherein the photosensitive member is elongated in an axial direction and has a length in the axial direction, the charger being elongated in the axial direction and having a length substantially the same as the length of the photosensitive member.

30. The image forming device as claimed in claim 29, wherein the process cartridge is inserted into the receiving section in an insertion direction that is substantially perpendicular to the axial direction.

31. The image forming device as claimed in claim 30, wherein the movable member has a plate shape with a free edge and a supported edge, the receiving section including a supporting portion that pivotably supports the supported edge of the movable member so that the movable member is pivotable between the non-contact position and the contact position.

32. The image forming device as claimed in claim 29, further comprising a driving force output section disposed on the receiving section and outputting a driving force, the process cartridge includes a rotating member and a drive force input section, the drive force input section receiving the drive force from the driving force output section to rotate the rotating member, the driving force output section being movable between an engagement position in engagement with the drive force input section of the process cartridge and a non-engagement position out of engagement with the input section of the process cartridge, the interlocking unit moving the driving force output section into the engagement position when the case cover is closed and into the non-engagement when the case cover is opened.

* * * * *